US009984536B2

(12) United States Patent
Weingardt et al.

(10) Patent No.: US 9,984,536 B2
(45) Date of Patent: May 29, 2018

(54) SPINNER BINGO GAME AND METHOD

(71) Applicant: Gary Weingardt, Las Vegas, NV (US)

(72) Inventors: Gary Weingardt, Las Vegas, NV (US); Jefferson Craig Lind, Austin, TX (US)

(73) Assignee: Gary Weingardt, Las Vegas, NV (US)

( * ) Notice: Subject to any disclaimer, the term of this patent is extended or adjusted under 35 U.S.C. 154(b) by 0 days. days.

(21) Appl. No.: 15/169,649

(22) Filed: May 31, 2016

(65) Prior Publication Data

US 2016/0358409 A1 Dec. 8, 2016

Related U.S. Application Data

(60) Provisional application No. 62/169,918, filed on Jun. 2, 2015.

(51) Int. Cl.
*G07F 17/32* (2006.01)

(52) U.S. Cl.
CPC ..... *G07F 17/329* (2013.01); *G07F 17/3244* (2013.01)

(58) Field of Classification Search
CPC ..... G07F 17/32
See application file for complete search history.

(56) References Cited

U.S. PATENT DOCUMENTS 5,042,810 A * 8/1991 Williams ..... A63F 3/00157 273/143 R
5,482,289 A * 1/1996 Weingardt ..... A63F 3/0645 273/269
5,624,119 A * 4/1997 Leake ..... A63F 3/0645 273/139
5,743,798 A * 4/1998 Adams ..... A63F 5/00 273/142 B
5,909,875 A * 6/1999 Weingardt ..... A63F 3/0645 273/269
6,056,642 A * 5/2000 Bennett ..... G07F 17/3211 273/143 R
6,702,288 B1 * 3/2004 Ohman ..... A63F 1/04 273/269
8,740,687 B1 * 6/2014 Brown ..... G07F 17/326 463/16
2002/0117803 A1 * 8/2002 Weingardt ..... A63F 3/0645 273/269

(Continued)

FOREIGN PATENT DOCUMENTS

JP 2005168700 A * 6/2005

OTHER PUBLICATIONS

"Color Bingo" game released in 1952, pictures thereof printed from URL <https://www.etsy.com/ca/listing/238144557/vintage-color-bingo-by-ed-u-cards-1952>, 3 pages.*

*Primary Examiner* — Jason Skaarup
(74) *Attorney, Agent, or Firm* — Weiss & Moy, P.C.; Veronica-Adele R. Cao; Karen J. S. Fouts

(57) ABSTRACT

A spinner bingo game system and method is disclosed. A spinner bingo game wherein a winning player can win a first prize for winning the game by covering the game-ending pattern, win a larger secondary progressive prize for covering a single-colored secondary pattern portion of the game-ending pattern, and/or win an even larger tertiary progressive prize for covering the single-colored secondary pattern where a spinner element is also pointing to the same color.

29 Claims, 18 Drawing Sheets

(56) References Cited

U.S. PATENT DOCUMENTS

| | | | | |
|---|---|---|---|---|
| 2003/0144050 | A1* | 7/2003 | Keaton | G07F 17/329 463/19 |
| 2004/0132522 | A1* | 7/2004 | Seelig | G07F 17/3213 463/16 |
| 2004/0178579 | A1* | 9/2004 | Lowell | G07F 17/329 273/269 |
| 2005/0059470 | A1* | 3/2005 | Cannon | G07F 17/3267 463/19 |
| 2005/0059471 | A1* | 3/2005 | Cannon | G07F 17/3267 463/19 |
| 2005/0187014 | A1* | 8/2005 | Saffari | G07F 17/32 463/27 |
| 2006/0052160 | A1* | 3/2006 | Saffari | G07F 17/32 463/27 |
| 2006/0068875 | A1* | 3/2006 | Cregan | G07F 17/3211 463/16 |
| 2006/0073867 | A1* | 4/2006 | Rothkranz | G07F 17/3211 463/16 |
| 2008/0004098 | A1* | 1/2008 | Bennett | G07F 17/3286 463/16 |
| 2009/0117993 | A1* | 5/2009 | Bigelow, Jr. | G07F 17/34 463/22 |
| 2009/0143129 | A1* | 6/2009 | Bailey | G07F 17/329 463/19 |
| 2011/0118006 | A1* | 5/2011 | Acres | G07F 17/3227 463/25 |
| 2011/0230249 | A1* | 9/2011 | Harris | G07F 17/34 463/19 |
| 2014/0197598 | A1* | 7/2014 | King | A63F 5/00 273/269 |
| 2014/0221073 | A1* | 8/2014 | Pockaj | G07F 17/3286 463/19 |

* cited by examiner

| | Color (250) | Network (252) | Balls per Color (253) | Secondary Progressive Odds (254) | Spinner Wedge Percentage (256) | Odds of Spinner Landing on Color (258) | Tertiary Progressive Odds (260) |
|---|---|---|---|---|---|---|---|
| Progressive 1 | Blue | Wide Area | 7 | 1 in 14,974,358 | 20% | 1 in 5 | 1 in 106,181,818 |
| Progressive 2 | Green | Local Area | 12 | 1 in 7,078,787 | 20% | 1 in 5 | 1 in 27,809,523 |
| Progressive 3 | Purple | Local Area | 14 | 1 in 13,904,761 | 20% | 1 in 5 | 1 in 46,720,000 |
| Progressive 4 | Red | Local Area | 19 | 1 in 3,425,219 | 20% | 1 in 5 | 1 in 12,695,652 |
| Progressive 5 | Yellow | Local Area | 23 | 1 in 2,443,514 | 20% | 1 in 5 | 1 in 9,419,354 |

5 Color Spinner, Straight Line Bingo of all One Color

FIG. 9

SPINNER BINGO GAME AND METHOD

CROSS-REFERENCE TO RELATED APPLICATION

The present patent application claims the benefit of U.S. Provisional Application No. 62/169,918, entitled "Spinner Bingo Game," which was filed on Jun. 2, 2015 in the name of one of the inventors herein, Gary Weingardt, and which is incorporated herein by reference. The present application is also related to U.S. Pat. No. 5,727,786 issued on Mar. 17, 1998 and U.S. Pat. No. 6,565,091 issued on May 20, 2003, which are both incorporated in full herein by reference.

TECHNICAL FIELD

This invention relates generally to bingo games, and more particularly to a bingo game that utilizes colored numbers, an element of chance, and progressive jackpot pools, which are designed to increase the attractiveness and excitement of the game to the players.

BACKGROUND

Bingo is a popular game throughout the United States and around the world consisting of multiple players competing to be the first to achieve one or more predesignated patterns by matching randomly drawn numbers to one or more unique, predesignated paper or electronic bingo cards. The first player to achieve a predesignated pattern on his bingo card is awarded a prize.

Technology has enabled many variations on bingo allowing a single player to play large numbers of electronic cards in a single game, entertaining displays of cards, objects drawn, and results, and other unique game play characteristics.

Electronic aids and computer networks have enabled broader participation in bingo games by removing the restriction that all players be co-located in a single facility. Furthermore, this broadened participation has yielded a variety of unique game designs.

One such game design is the subject of the Weingardt patents (U.S. Pat. No. 5,727,786 and U.S. Pat. No. 6,565,091). The Weingardt patents disclose a bingo game featuring bingo cards with color designations added to the traditional columns and rows of numbers. In these inventions, the player may receive a progressive jackpot prize by achieving the game-ending bingo pattern, and also by covering a secondary pattern of all one color (e.g. a straight line of blue numbers). This secondary colored pattern awards an advertised amount associated with the specific color. A typical game may include several jackpot colors. For example, a game may include five colors (red, blue, yellow, green, and purple) associated with five separate jackpots.

This game has proven popular with players by enabling the advertising of large, growing jackpots not typically associated with bingo games. The color designations on the bingo card enable these large jackpots by extending the available outcomes and probabilities of a multiplayer bingo game. A player that wins has the possibility of winning a much larger prize by meeting the color criteria.

SUMMARY OF THE INVENTION

This summary is provided to introduce a selection of concepts of the present invention in a simplified form that are further described in detail below in the DETAILED DESCRIPTION OF THE INVENTION. This summary is not intended to identify each and every key feature of the invention, which remains the exclusive purview of claims, nor is the Summary intended to be used as an aid in determining the scope of the claimed subject matter.

The present invention expands on the success of the games disclosed in U.S. Pat. No. 5,727,786 and U.S. Pat. No. 6,565,091 by adding a new element of chance; a color selecting spinner, to further extend the probabilities and possible prizes for the game winner. The result is that a winning player can win a prize for winning the game by covering the game-ending pattern, a larger secondary progressive prize for covering a single-colored secondary pattern, and/or an even larger tertiary progressive prize for covering the single colored secondary pattern where the spinner element is also pointing to the same color.

All of the possible bingo numbers are displayed on an electronic reader board within a gaming facility or on a networked display available to each player. At the beginning of each game, a random number generator (manual or electronic) selects a predetermined subset of the bingo numbers to be displayed as blue. Additionally another subset of the bingo numbers is randomly selected to be displayed as green. An additional subset may be randomly selected to be displayed as red, and so on for a fixed number of colors (typically between four and six, but any number of colors may be used so long as it is possible to achieve a bingo pattern associated with one of the colors). The most popular color jackpots are dependent upon winning the game-ending pattern (GEP), with the secondary color pattern being either a straight line of five spaces anywhere on the bingo card or being the straight line portion of the GEP. Of course there could be other secondary patterns other than the straight line pattern.

A spinner device, also displayed on the electronic reader board, is spun to select a color corresponding to the colors displayed on the reader board. This selection may occur before or after the assignment of colors to the bingo numbers on the electronic reader board, depending on current gaming regulations.

When a player achieves a bingo, the player wins certain pre-established payouts depending upon whether the player has a blue bingo, a green bingo, a red bingo, or any bingo associated with one of the colors, in addition to the GEP prize.

When a player achieves a bingo and the spinner is on the matching color as the bingo, the player wins certain pre-established payouts associated with the spinner color for a blue bingo, a green bingo, a red bingo, or any bingo color jackpot matching the spinner color.

In accordance with one embodiment of the present invention, a method of playing a multi-progressive bingo game is disclosed. The method comprises the steps of: providing a plurality of bingo gaming machines networked together and connected to a game server, each bingo gaming machine comprising a housing, a screen coupled to the housing, a plurality of input devices coupled to the housing, the plurality of input devices including an acceptor configured to receive a wager and establish a credit balance, and an electronic processing device coupled to the housing, the electronic processing device configured to operate the screen and the plurality of input devices; providing a plurality of electronic bingo balls, each electronic bingo ball having a different number; providing an electronic number reader board having seventy-five numbered spaces corresponding to seventy-five electronic bingo balls used in the bingo game; providing a plurality of players, each with a plurality of bingo cards, the bingo cards having a plurality of numbered spaces, wherein the spaces are arranged in five columns and five rows; randomly assigning seven numbers on the electronic reader board with a blue color; randomly assigning twelve numbers on the electronic reader board with a green color; randomly assigning fourteen numbers on the electronic reader board with a purple color; randomly assigning nineteen numbers on the electronic reader board with a red color; randomly assigning twenty-three numbers on the electronic reader board with a yellow color; providing a spinner display having one blue wedge portion, one green wedge portion, one purple wedge portion, one red wedge portion, and one yellow wedge portion; providing a spinner device that may select among the blue wedge portion, the green wedge portion, the purple wedge portion, the red wedge portion, and the yellow wedge portion; spinning the spinner device; initiating a bingo game; randomly selecting bingo balls until a player covers a predetermined game-ending pattern on the bingo card; if the player covers the game-ending pattern, awarding the player with a first amount; if the player also covers a predetermined secondary pattern on the bingo card only with numbers having the same color, awarding the player with a second amount; if the spinner device selected a wedge portion of the spinner display that matches the color of the secondary pattern on the bingo card, awarding the player with a third amount; and if a player covers a hard-way straight-line preliminary progressive jackpot pattern on the bingo card prior to any player covering the game-ending pattern and the hard-way straight-line pattern is covered only with numbers having a predetermined color, awarding the player with a fourth amount.

In accordance with another embodiment of the present invention, a method of playing a multi-progressive bingo game is disclosed. The method comprises the steps of: providing a plurality of bingo gaming machines networked together and connected to a game server, each bingo gaming machine comprising a housing, a screen coupled to the housing, a plurality of input devices coupled to the housing, the plurality of input devices including an acceptor configured to receive a wager, and an electronic processing device coupled to the housing, the electronic processing device configured to operate the screen and the plurality of input devices; providing a plurality of electronic bingo balls, each electronic bingo ball having a different number; providing an electronic number reader board having seventy-five numbered spaces corresponding to seventy-five electronic bingo balls used in the bingo game; providing plurality players with a plurality of bingo cards, the bingo card having a plurality of numbered spaces, wherein the spaces are arranged in five columns and five rows; randomly assigning seven numbers on the electronic reader board with blue; randomly assigning twelve numbers on the electronic reader board with green; randomly assigning fourteen numbers on the electronic reader board with purple; randomly assigning nineteen numbers on the electronic reader board with red; randomly assigning twenty-three numbers on the electronic reader board with yellow; providing a spinner display having one blue wedge portion, one green wedge portion, one purple wedge portion, one red wedge portion, and one yellow wedge portion; providing a spinner device that may select among the blue wedge portion, the green wedge portion, the purple wedge portion, the red wedge portion, and the yellow wedge portion; spinning the spinner device; initiating a bingo game; randomly selecting bingo balls until a player covers a predetermined game-ending pattern on the bingo card; if the player covers the game-ending pattern, awarding the player with a first amount; if the player also covers a predetermined secondary pattern on the bingo card only with numbers having the same color, awarding the player with a second amount; and if the spinner device selected a wedge portion of the spinner display that matches the color of the secondary pattern on the bingo card, awarding the player with a third amount.

In accordance with another embodiment of the present invention, a method of playing a multi-progressive bingo game is disclosed. The method comprises the steps of: providing a plurality of bingo gaming machines networked together and connected to a game server, each bingo gaming machine comprising a housing, a screen coupled to the housing, a plurality of input devices coupled to the housing, the plurality of input devices including an acceptor configured to receive a wager, and an electronic processing device coupled to the housing, the electronic processing device configured to operate the screen and the plurality of input devices; providing a plurality of electronic bingo balls, each bingo ball having a different number; providing an electronic number reader board having a plurality of numbered spaces corresponding to the number of bingo balls used in the bingo game; providing a plurality of players with a plurality of bingo cards, the bingo cards having a plurality of numbered spaces; randomly assigning a predetermined amount of numbers on the electronic reader board with a first color; randomly assigning a predetermined amount of numbers on the electronic reader board with a second color; randomly assigning a predetermined amount of numbers on the electronic reader board with a third color; randomly assigning a predetermined amount of numbers on the electronic reader board with a fourth color; randomly assigning a predetermined amount of numbers on the electronic reader board with a fifth color; providing a spinner display wherein at least one wedge portion of the spinner display matches each of the first color, the second color, the third color, the fourth color, and the fifth color; providing a spinner device that may select among each of the wedge portions of the spinner display that match the first color, the second color, the third color, the fourth color, and the fifth color; spinning the spinner device; initiating a bingo game; randomly selecting bingo balls until a player covers a predetermined game-ending pattern on the bingo card; if the player covers the game-ending pattern, awarding the player with a first amount; if the player also covers a predetermined secondary pattern on the bingo card only with numbers having the same color, awarding the player with a second amount; and if the spinner device selected a wedge portion of the spinner display that matches the color of the secondary pattern on the bingo card, awarding the player with a third amount.

In accordance with another embodiment of the present invention, a method of playing a multi-progressive bingo game comprising the steps of: providing a plurality of bingo gaming machines networked together and connected to a game server, each bingo gaming machine comprising a housing, a screen coupled to the housing, a plurality of input devices coupled to the housing, the plurality of input devices including an acceptor configured to receive a wager, and an electronic processing device coupled to the housing, the electronic processing device configured to operate the screen and the plurality of input devices; providing a plurality of electronic bingo balls, each electronic bingo ball having a different number; providing an electronic number reader board having a plurality of numbered spaces corresponding to the number of electronic bingo balls used in the bingo game; providing a plurality of players with a plurality of bingo cards, the bingo cards having a plurality of numbered spaces; randomly assigning a predetermined amount of numbers on the electronic reader board with a first designated marking; randomly assigning a predetermined amount of numbers on the electronic reader board with a second designated marking; randomly assigning a predetermined amount of numbers on the electronic reader board with a third designated marking; randomly assigning a predetermined amount of numbers on the electronic reader board with a fourth designated marking; providing a spinner display wherein at least one wedge portion of the spinner display matches each of the first designated marking, the second designated marking, the third designated marking, and the fourth designated marking; providing a spinner device that may select among each of the wedge portions of the spinner display that match the first designated marking, the second designated marking, the third designated marking, and the fourth designated marking; spinning the spinner device; initiating a bingo game; randomly selecting bingo balls until a player covers a predetermined game-ending pattern on the bingo card; if the player covers the game-ending pattern, awarding the player with a first amount; if the player also covers a predetermined secondary pattern on the bingo card only with numbers having the same color, awarding the player with a second amount; and if the spinner device selected a portion of the spinner display that matches the designated marking of the secondary pattern on the bingo card, awarding the player with a third amount.

In accordance with another embodiment of the present invention, a method of playing a multi-progressive bingo game comprising the steps of: providing a plurality of bingo gaming machines networked together and connected to a game server, each bingo gaming machine comprising a housing, a screen coupled the housing, a plurality of input devices coupled to the housing, the plurality of input devices including an acceptor configured to receive a wager, and an electronic processing device coupled to the housing, the electronic processing device configured to operate the screen and the plurality of input devices; providing a plurality of electronic bingo balls, each electronic bingo ball having a different number; providing an electronic number reader board having a plurality of numbered spaces corresponding to the number of electronic bingo balls used in the bingo game; providing a plurality of players with a bingo card, the bingo card having a plurality of numbered spaces; randomly assigning a predetermined amount of numbers on the electronic reader board with at least one designated marking; providing a spinner display wherein at least one wedge portion of the spinner display matches the at least one designated marking assigned to the predetermined amount of numbers on the electronic reader board; providing a spinner device that may select the at least one wedge portion of the spinner display that matches the at least one designated marking assigned to the predetermined amount of numbers on the electronic reader board; spinning the spinner device; initiating a bingo game; randomly selecting bingo balls until a player covers a predetermined game-ending pattern on the bingo card; if the player covers the game-ending pattern, awarding the player with a first amount; if the player also covers a predetermined secondary pattern on the bingo card only with numbers having the same designated marking, awarding the player with a second amount; and if the spinner device selected the at least one wedge portion of the spinner display that matches the at least one designated marking, awarding the player with a third amount.

BRIEF DESCRIPTION OF THE DRAWINGS

Embodiments of the disclosure will become more fully understood from the detailed description and the accompanying drawings, wherein:

FIG. 9 shows an example of an odds table for one embodiment of the present invention where there are five colors associated with five color progressives;

DETAILED DESCRIPTION OF THE INVENTION

The description set forth below in connection with the appended drawings is intended as a detailed description of presently known exemplary embodiments of the disclosure and is not intended to represent the only forms in which the present invention can, may, or could be constructed and/or utilized. The detailed description sets forth the functions and the sequence of the steps for constructing and operating the disclosure in connection with the illustrated embodiments as well as the best mode of carrying out the invention. It is to be understood, however, that the same or equivalent functions and sequences can be accomplished by different exemplary embodiments that are also intended to be encompassed within the spirit and scope of this invention.

Figure 1:
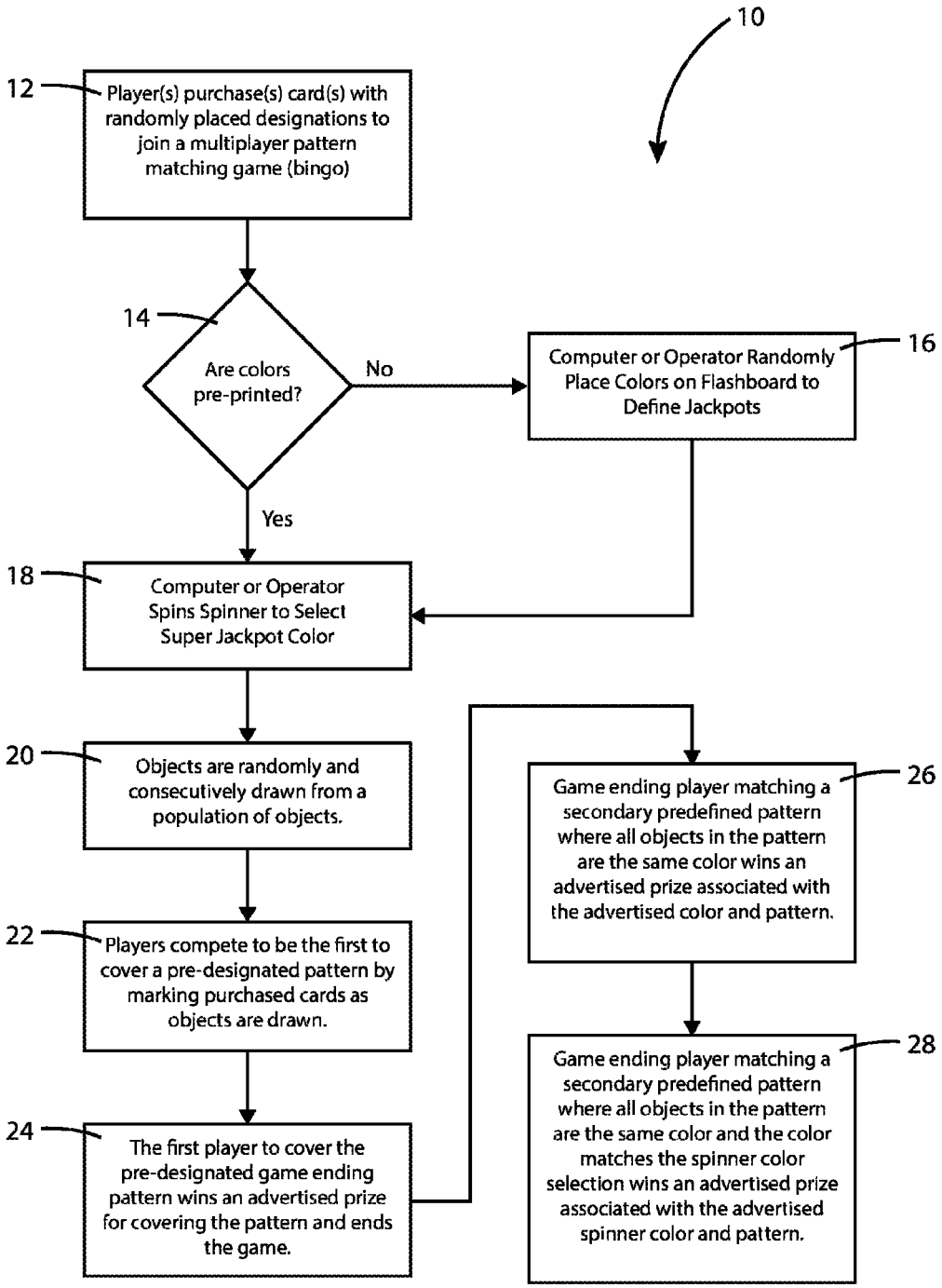
FIG. 1 shows a flow chart depicting the game play process for the spinner bingo game consisting of a game-ending pattern prize, a secondary progressive prize for achieving a secondary colored pattern, and a third progressive prize for achieving the colored pattern of the secondary prize including the spinner matching that color.

FIG. 1 shows the game play and prize determination process 10 for the invention. The process begins at step 12 with the player purchasing one or more bingo cards to enter a multiplayer bingo game that can be played either electronically or on paper. Depending on the implementation, the bingo cards may be pre-printed with numbered squares that have designated markings (such as colors) or the cards may only include the numbers and no designated markings. Although the designated markings described herein are colors, it should be clearly understood that substantial benefit may still be derived if designated markings other than color are used. In the case that cards are not pre-printed with colors, the flashboard at step 16 is randomly assigned colors that are implied to be present on the cards. This process can be automatic or initiated by an operator.

After bingo cards have been sold at step 12 and colors defined at step 14/16, a computer or operator spins a spinner at step 18 to determine the spinner bonus color for the game (e.g. the spinner may select the color blue). The bonus color is determined when the spinning device stops on one of the colors assigned to numbers on the bingo cards or the flashboard.

At step 20, objects such as bingo balls are randomly drawn and revealed sequentially from a population of shuffled objects or by an electronic random number generator. At step 22, players mark their cards manually or use an electronic aid with the goal of being the first to cover a pre-designated game-ending pattern. At step 24, the first player to cover the pre-designated game-ending pattern ends the game, thus stopping the sequential drawing of objects and receives the game-ending prize associated with the pre-designated pattern. In one embodiment, the game may be automatically stopped when a player covers the game-ending pattern. Alternatively, the game may be stopped only when a player covers the game-ending pattern and says "BINGO" out loud. At step 26, the player may also receive a large fixed or progressive jackpot if the player has also covered a secondary, pre-designated pattern at the same time the game-ending pattern is achieved. This prize is awarded only if the secondary pattern is a single color and is completely covered upon the game-ending (e.g. a straight line of blue numbers). At step 28, the player will receive a larger fixed or progressive jackpot if the color of the secondary pattern (e.g. blue) also matches the color selected by the spinner mechanism when the game-ending pattern is achieved.

Figure 2:
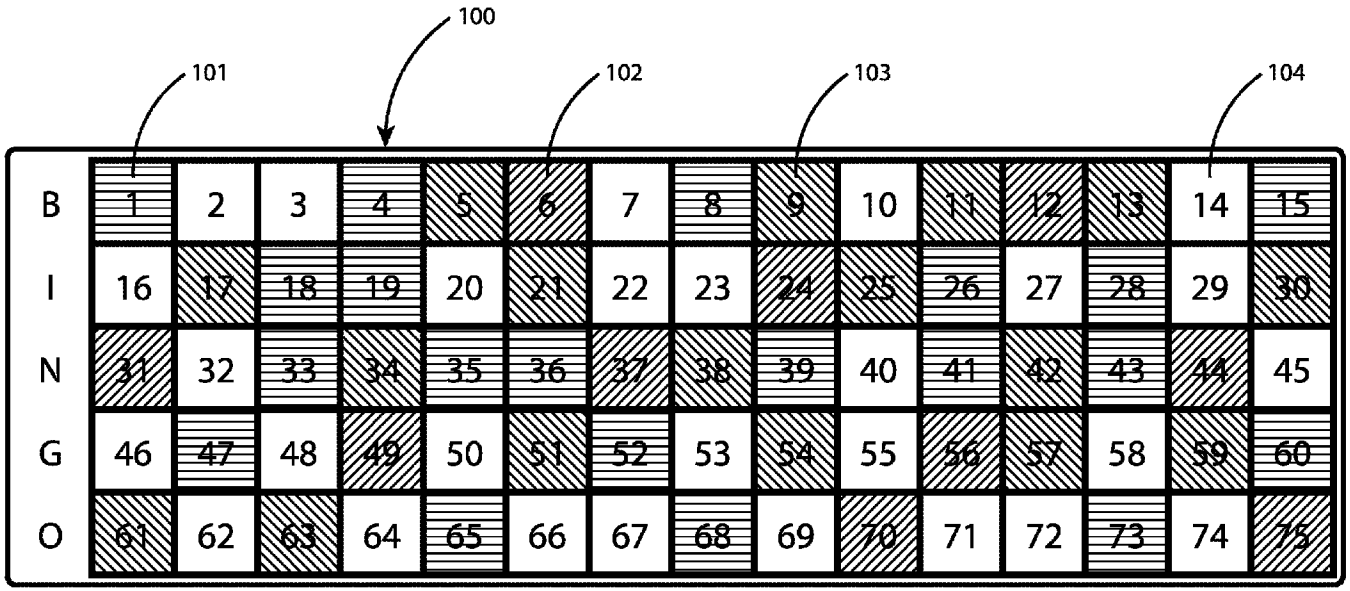
FIG. 2 shows an exemplary electronic bingo reader board depicting numbers with one of four color designations.
Figure 3:
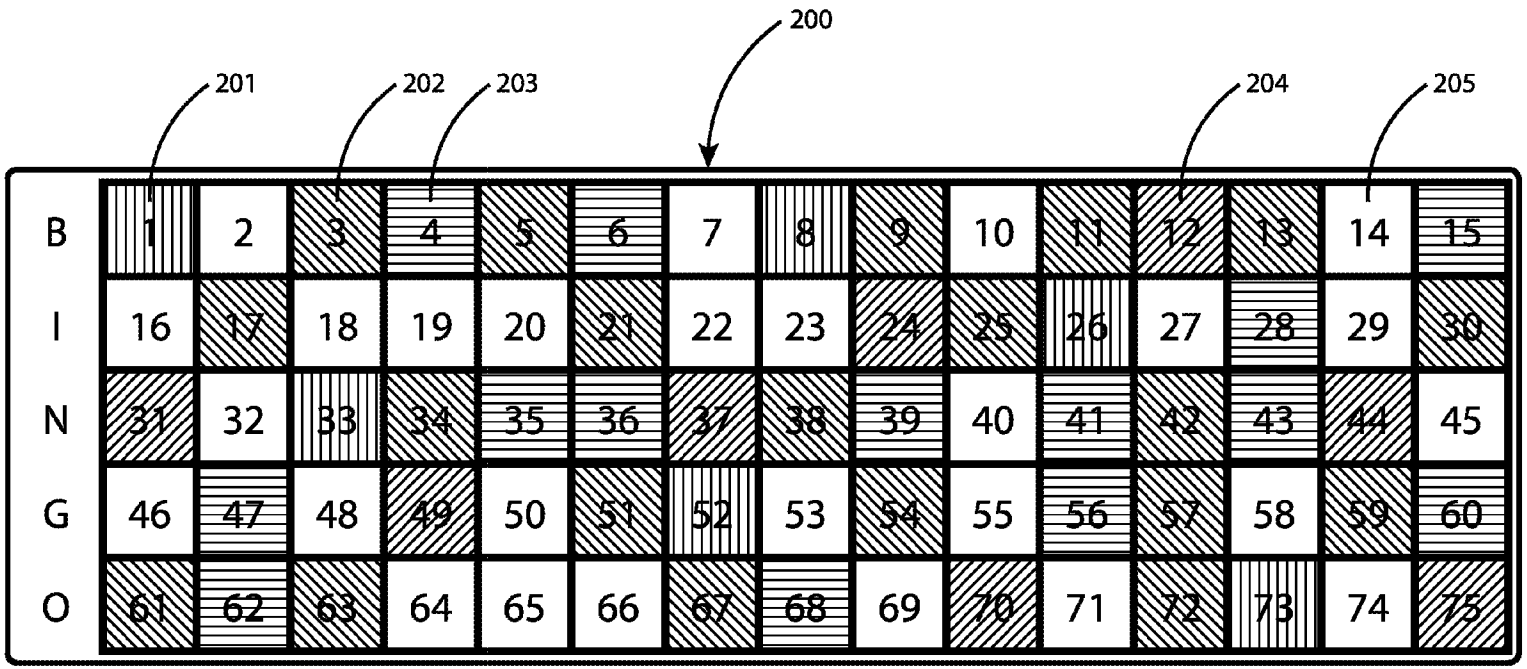
FIG. 3 shows an alternative bingo reader board depicting numbers with one of five color designations.
Figure 4:
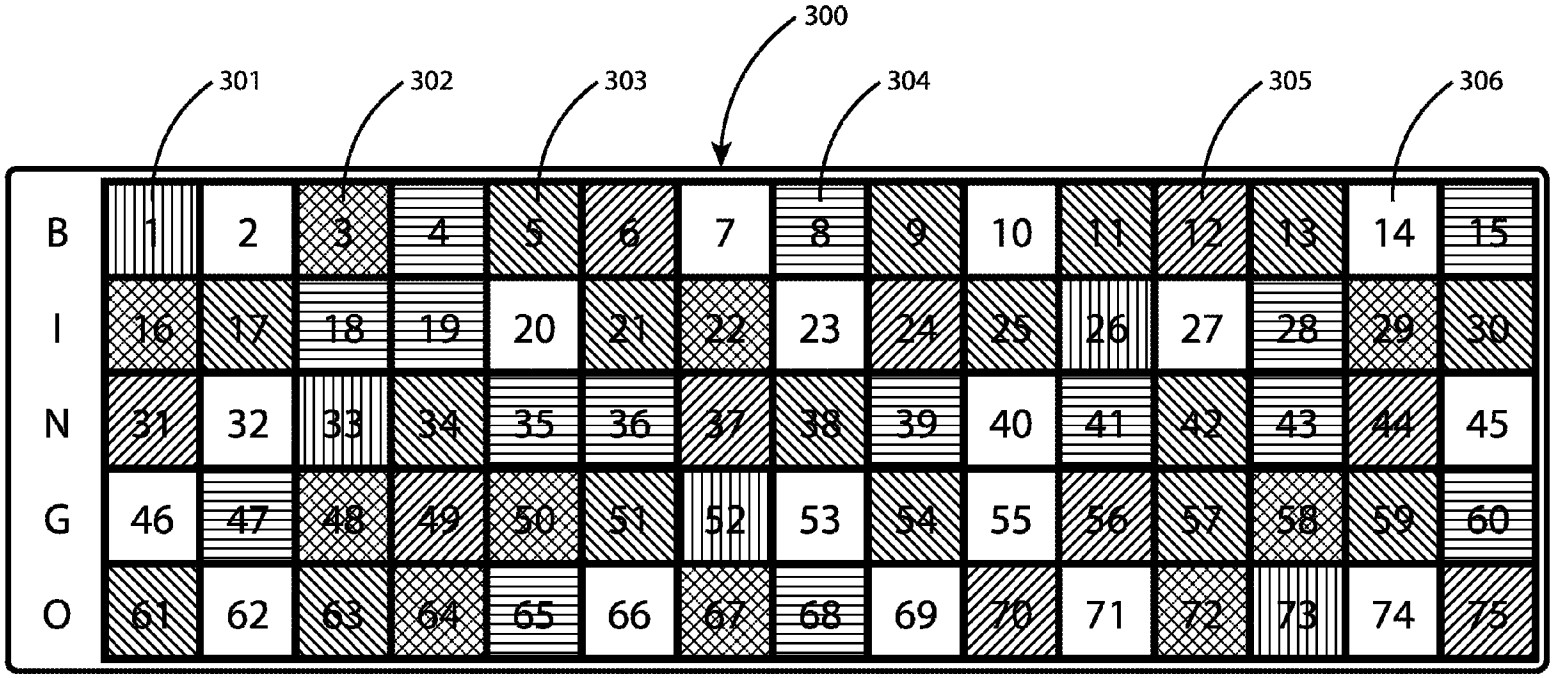
FIG. 4 shows an alternative bingo reader board depicting numbers with one of six color designations.

FIG. 2 depicts a traditional bingo reader board 100 with four colors assigned where numbers are blue 101, green 102, red 103, or yellow 104. Although these are the colors that are used in this example, it should be clearly understood that colors other than blue, red, yellow, and green may be used. The bingo reader board 100 of the figures herein has seventy-five numbers. However, it should be clearly understood that substantial benefit may be derived where more than seventy-five or less that seventy-five numbers are used. All numbers on the bingo flashboard are assigned one of the four colors. However, it should be clearly understood that substantial benefit may still be derived in one or more of the numbers on the bingo flashboard were not assigned any colors. Alternatively, FIG. 3 depicts a traditional bingo reader board 200 with five colors assigned where numbers are blue 201, green 202, purple 203, red 204, or yellow 205. Although these are the colors that are used in this example, it should be clearly understood that colors other than blue, red, purple, green, and yellow may be used. A third alternative is depicted in FIG. 4 where the bingo reader board 300 is assigned six colors including blue 301, green 302, purple 303, red 304, yellow 305, and orange 306. Although these are the colors that are used in this example, it should be clearly understood that colors other than blue, red, purple, green, yellow, and orange may be used. Furthermore, any number of colors may be used as long as it is possible to cover the winning pattern of a single color. The amount of colored numbers assigned to each jackpot can vary; i.e. colors with fewer numbers will have lower probabilities of occurring, higher jackpots and be harder to achieve; while colors assigned to larger amounts of numbers will have higher probabilities of occurring and smaller jackpots, but will be achieved more often.

Figure 5:
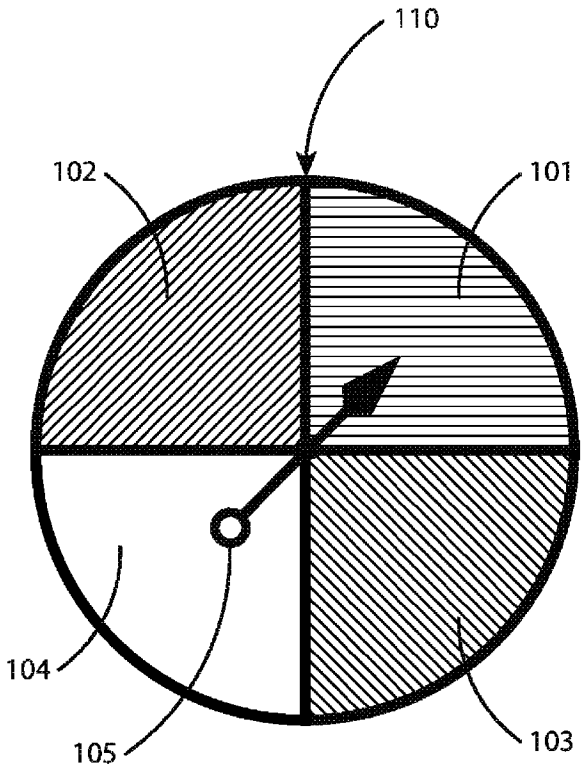
FIG. 5 shows a pointer type spinner with four color designations.

FIG. 5 depicts a color selecting pointer-style spinner device 110 associated with the four-color reader board 100 where the spinner 110 includes the four colors of the reader board 100 where each color is assigned a wedge on the spinner (blue 101, green 102, red 103, or yellow 104) and a pointer 105 that can be spun and allowed to settle on one of the four colors. As depicted, each color is assigned an equal sized wedge on the spinner device 110 resulting in an equal probability of landing on each color. Alternatively, the game may be implemented with unequally sized wedges to vary the probability of each color being selected by the spinner 110.

Figure 6B:
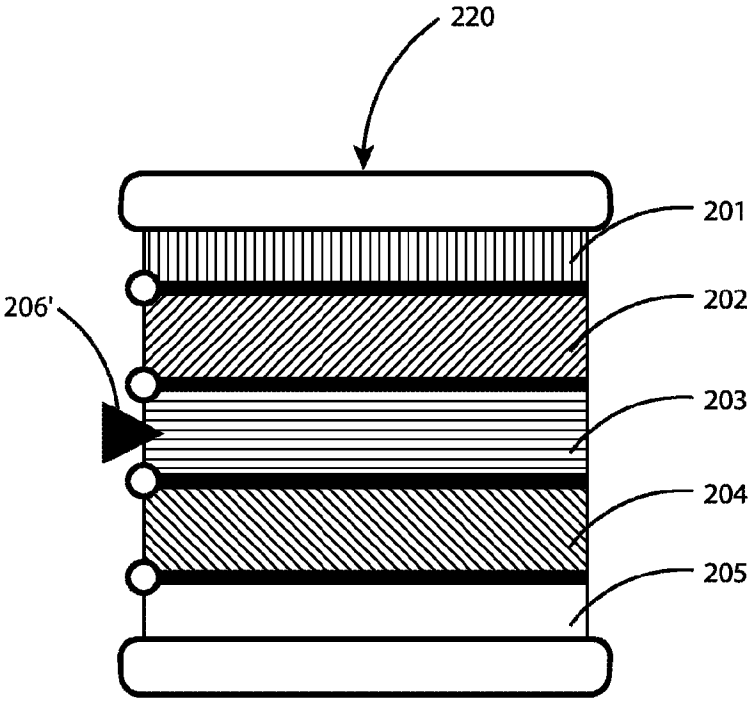
FIG. 6*b* shows an alternative cylinder type spinner with five color designations.
Figure 6A:
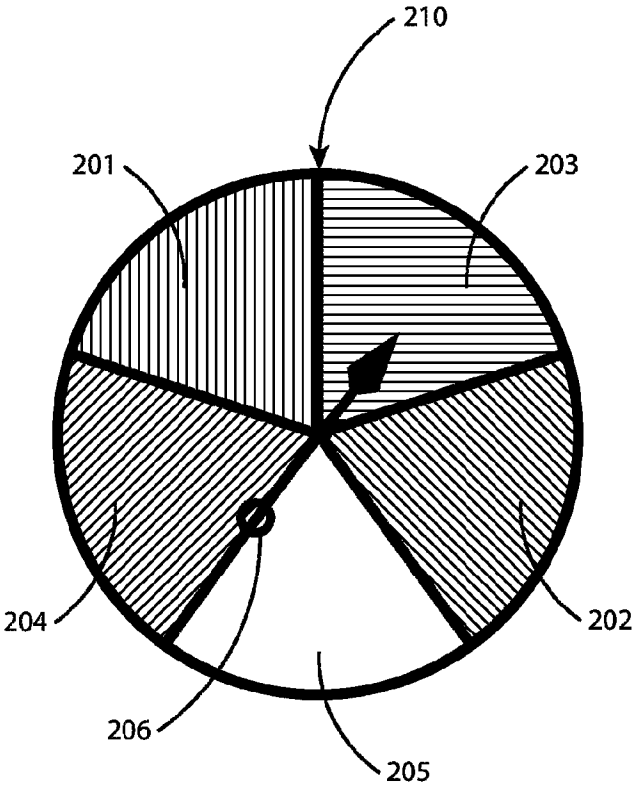
FIG. 6*a* shows an alternative pointer type spinner with five color designations.

FIG. 6*a* shows an alternative spinner device 210 with the five colors of the five color reader board 200 where each color is assigned a wedge on the spinner (blue 201, green 202, purple 203, red 204 or yellow 205) and a pointer 206 for selecting the color that can be spun and allowed to settle on one of the five colors. As depicted, each color is assigned an equal sized wedge on the spinner device 210 resulting in an equal probability of landing on each color. Alternatively, the game may be implemented with unequally sized wedges to vary the probability of each color being selected by the spinner and a pointer 206 for selecting the color. FIG. 6*b* shows an alternative "cylinder" style spinner device 220 with the same five colors on the five color reader board 200 and a pointer 206'. The cylinder-style spinner 220 has a fixed pointer 206' and a spinning color wheel. Many variants of the spinning device are conceivable. As depicted, each color is assigned an equal sized wedge on the spinner device 210 resulting in an equal probability of landing on each color.

Alternatively, the game may be implemented with unequally sized wedges to vary the probability of each color being selected by the spinner 210.

Figure 7:
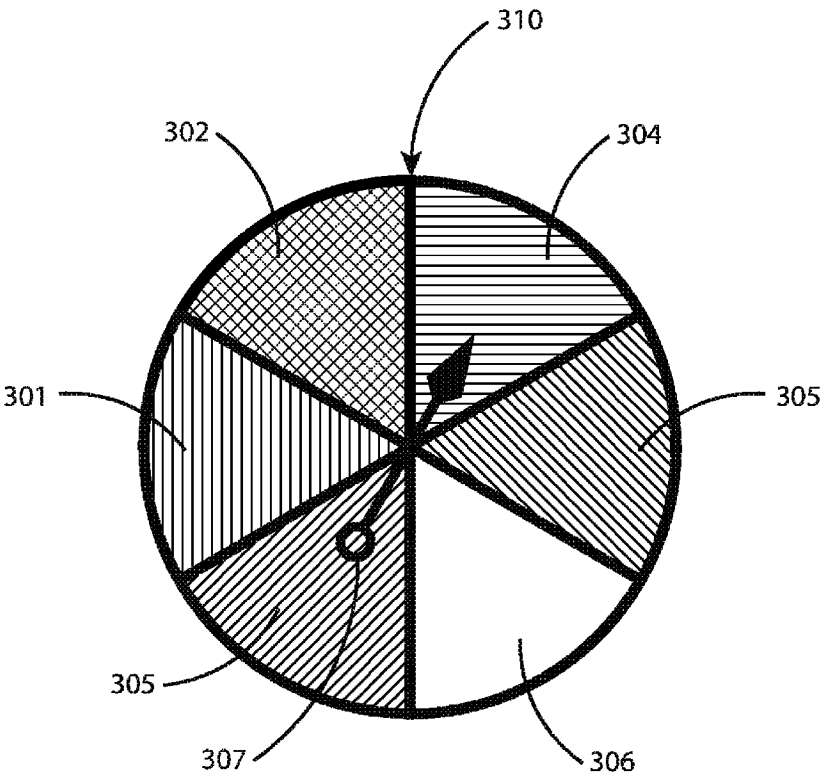
FIG. 7 shows an alternative pointer type spinner with six color designations.

FIG. 7 shows an alternative spinner device 310 with the six colors of the six color reader board 300 and a pointer 307. As depicted, each color is assigned an equal sized wedge on the spinner device 310 resulting in an equal probability of landing on each color. Alternatively, the game may be implemented with unequally sized wedges to vary the probability of each color being selected by the spinner 310.

Figure 8:
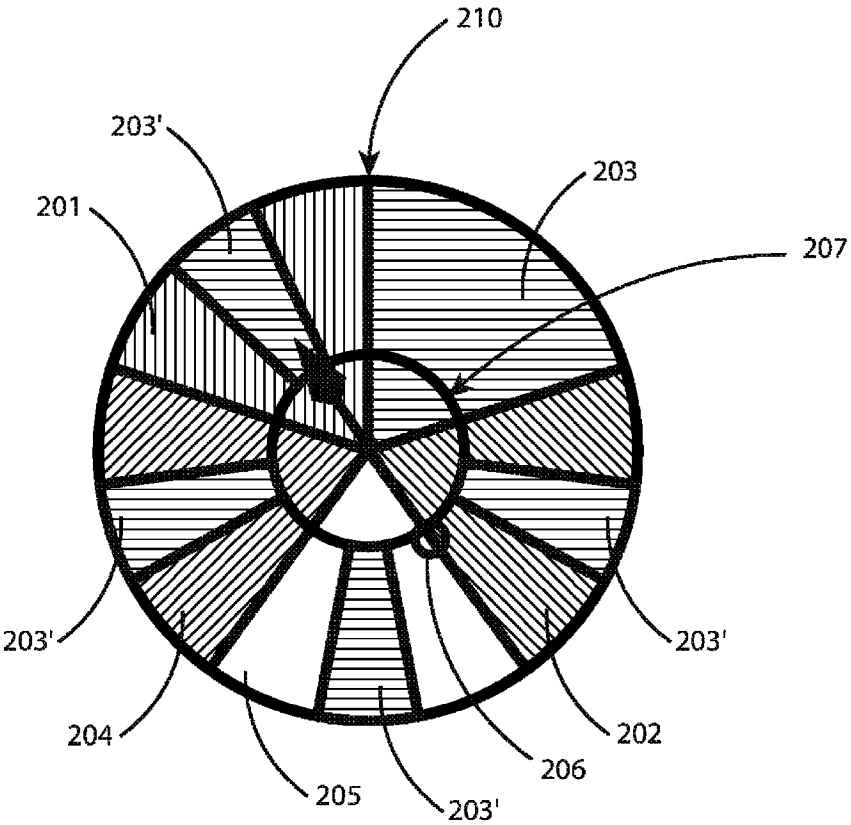
FIG. 8 shows an alternative pointer type spinner with additional sections allocated for one of the five color designations.

In some cases it is desirable to adjust the ratio of colors on the spinner device to raise or lower the odds of the spinner landing on a color. One anticipated scenario occurs when a jackpot has reached a prize target amount. This prize target amount is defined as a "must-go" prize. An operator may adjust the color ratios on the spinner to improve the likelihood the must-go will be awarded. For example, FIG. 8 depicts a five color spinner device 210' where additional overlay color segments have been added to increase the probability of the pointer 206 landing on the purple jackpot 203. In this example, three additional overlay purple wedges 203' are added to the spinner device 210'; one additional overlay purple wedge 203' is added to the middle of the blue wedge 201, one additional overlay purple wedge 203' is added to the middle of the red wedge 204, one additional overlay purple wedge 203' is added to the middle of the green wedge 202. The addition of the additional overlay purple wedges 203' does not change the overall color of each of the wedges that they are inserted into, as shown by the center circle 207 portion of the primary wedge. The underlying color of the other wedges is still visible within the center circle 207. In the example shown, if a player covers the game-ending pattern, covers a straight-line pattern with numbers that have been assigned the color blue, and the pointer 206 landed on the additional overlay purple wedge 203' that is in the middle of the blue wedge 201, the player would receive the blue tertiary spinner color jackpot 502. However, if a player covers the game-ending pattern, covers a straight-line pattern with numbers that have been assigned the color purple, and the pointer 206 landed on the additional overlay purple wedge 203' that is in the middle of the blue wedge 201 (or on any of the additional overlay purple wedges 203' for that matter), the player would receive the purple tertiary spinner color jackpot 504. In other words, the additional purple overlay wedges 203' only convey the benefits of a purple wedge 203 when the player covers the game-ending pattern and covers a straight-line pattern with numbers that have been assigned the color purple. Otherwise, if the player does not cover the game-ending pattern at all or if the player covers the game-ending pattern and covers a straight-line pattern with numbers that have been assigned to a color other than purple, then the additional purple overlay wedge 203' does nothing and the pointer 206 is assumed to be pointing at its underlying wedge color. Overlays are continually added at predetermined intervals at the discretion of the game operator until the must-go has achieved its purpose and the spinner progressive jackpot is hit. Adding overlay wedges of colors to the spinner device is not meant to be a limiting factor; other methods to decrease the probabilities could also be used.

The preferred embodiment includes multiple progressive jackpots where some are linked to players in a close physical proximity and others include players that are geographically separated. Players in a single facility or close geographical location participate in progressive jackpots on a "local area" network. Geographically separated players participate in a "wide area" network. Players typically are playing for multiple progressive prizes in a single bingo game and some of these prizes are local while others are wide. The amount of money in a jackpot is a function of the number of participants contributing to the jackpot, the percentage of each participant's purchase contributed to the jackpot, and the probability of that jackpot being won by matching the predefined bingo criteria.

The odds of achieving a single color progressive (secondary) or single color with spinner progressive (tertiary) are determined by the rules of the game, the game-ending patterns in play, the number of balls assigned to each color, and the size of the spinner wedges assigned to each color. FIG. 9 provides an example of an odds table for one embodiment where there are five colors associated with five progressives. The second column (250) in the table lists the five colors associated with the five progressives. The next column (252) defines whether the progressive is played locally or over a wide area network. The fourth column (253) lists the amount of balls of a 75-ball population associated with each of the five colors listed in the first column (250). Using the number of balls associated with each color (see column 253) in conjunction with the on-the-way progressive pattern(s) in play and rules of the game (some implementations may require a the progressive winner to also be the first to achieve the game-ending pattern while others may not), the odds of a player achieving each of the single color progressives can be calculated. A sample set of odds for the secondary (color matched) progressive prizes based on the color is listed in column 254. Column 256 shows the weight or percentage of the spinner 210 given to each color. This percentage can be displayed as odds (see column 258) and, together with the odds of the secondary progressive (see column 254) produces the tertiary progressive odds (see column 260) for this sample embodiment.

FIGS. 10-15 describe an example of the game play for one embodiment of the invention using a five-color reader board/flashboard 200 and a pointer-style spinner 210.

Figure 10:
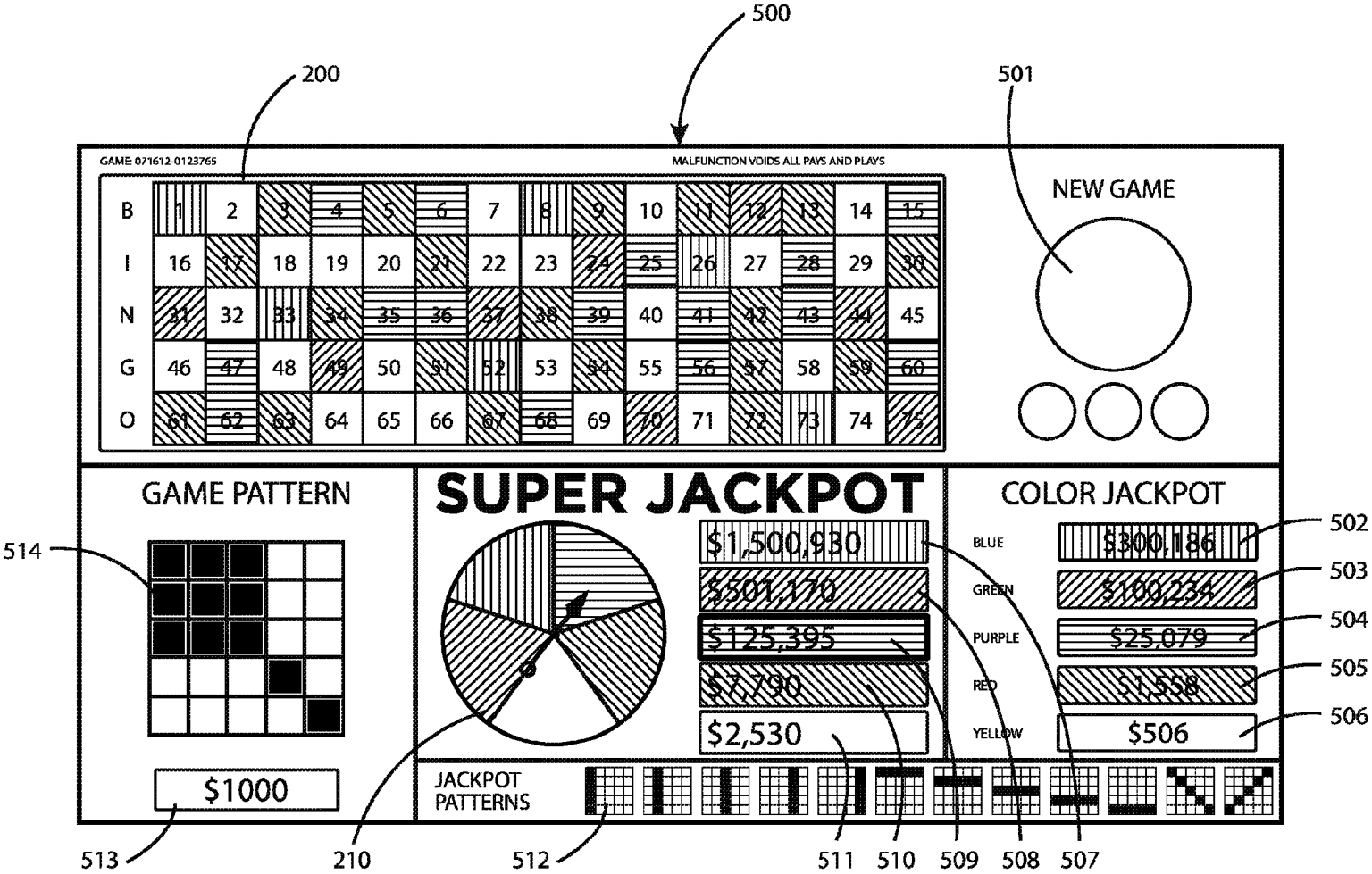
FIG. 10 shows a complete electronic reader board screen prior to drawing bingo balls with all components of the game (other than the player's bingo card) including the electronic reader board with five color designations, the current ball drawn, the game-ending pattern and prize, the color associated progressive prizes and patterns, the color associated spinner prizes and patterns, and the prize selecting spinner.

FIG. 10 shows the complete electronic reader board display 500 on a gaming machine, which includes a five-color reader board 200 with a color assigned to each number in the bingo population. The display 500 also has a space allocated for the most recent balls drawn 501, the game-ending pattern 514 (shown here as a kite-shaped pattern), and its associated payout 513. The color jackpot patterns 512 are also shown. The color jackpot patterns 512, in this example, consist of twelve possible five-space straight line bingo patterns. A color jackpot prize is associated with each color; for example, if the player covers the kite-shaped game-ending pattern 514 and also covers a five-space straight line pattern made up of all blue numbers on his bingo card, then the player would win the secondary color jackpot associated with the color blue. In this embodiment, the player must cover the game-ending pattern on his bingo card in order to be able to win the secondary color jackpot; i.e. if a player covers a five-space straight line pattern made up of all green numbers, but does not cover the game-ending pattern, the player does not win the secondary color jackpot associated with the color green. The jackpot amounts for the blue secondary color jackpot 502, green secondary color jackpot 503, purple secondary color jackpot 504, red secondary color jackpot 505, and yellow color secondary jackpot 506 are all shown listed in the Color Jackpot section of the display 500. The display 500 also includes the pointer-style spinner wheel 210 and its associated color progressive jackpots; for example, the blue tertiary super progressive jackpot 507, green tertiary super jackpot 508, purple tertiary super jackpot 509, red tertiary super jackpot 510, and yellow tertiary super jackpot 511. In this example, each tertiary super jackpot color is represented by the same sized wedge on the pointer-style spinner wheel 210.

According to this example, in the pre-game state, colors are randomly assigned to the numbered squares on the electronic reader board 200 and the pointer on the spinner 210 is spun to select the super jackpot bonus color. At this point, the recent ball call area 501 may be unpopulated.

Figure 13:
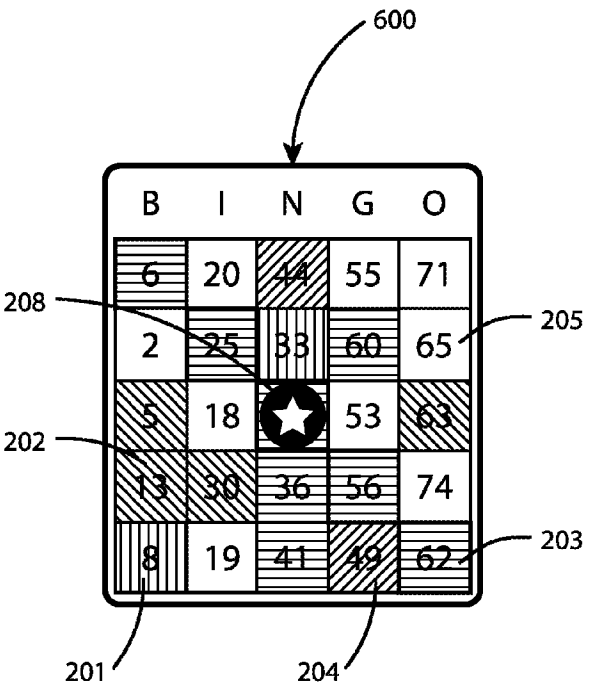
FIG. 13 shows an unmarked player's bingo card with five color designations including a progressive potential prize winning designation diagonally from the top left to the bottom right.

In the pre-game state, each player has obtained, usually through purchase, one or more unmarked bingo cards 600, as depicted in FIG. 13, with no spaces marked. In this case, the bingo card 600 includes five columns labeled (B-I-N-G-O), five rows, and a free space 208 at the center of the card (indicated in the examples herein as a star). The player's bingo card(s) 600 may be pre-printed with colors, assigned only by the electronic reader board/flashboard 200, or in the case of electronic cards, automatically populated after colors are assigned on the electronic reader board/flashboard 200. In the example bingo card 600, five colors are assigned, blue 201, green 202, purple 203, red 204, and yellow 205 to match the colors assigned on the electronic reader board/flashboard 200. Since a colored jackpot requires matching a colored jackpot pattern 512 of all one color, this card 600 has the potential to win the purple tertiary super jackpot 509 because of the diagonal straight line bingo (top left to bottom right) that is all purple 203 and because the spinner pointer 206 is pointing to the purple wedge on the spinner display 210. In order to win the purple tertiary super jackpot 509, however, the player must also cover the game-ending pattern.

Figure 11:
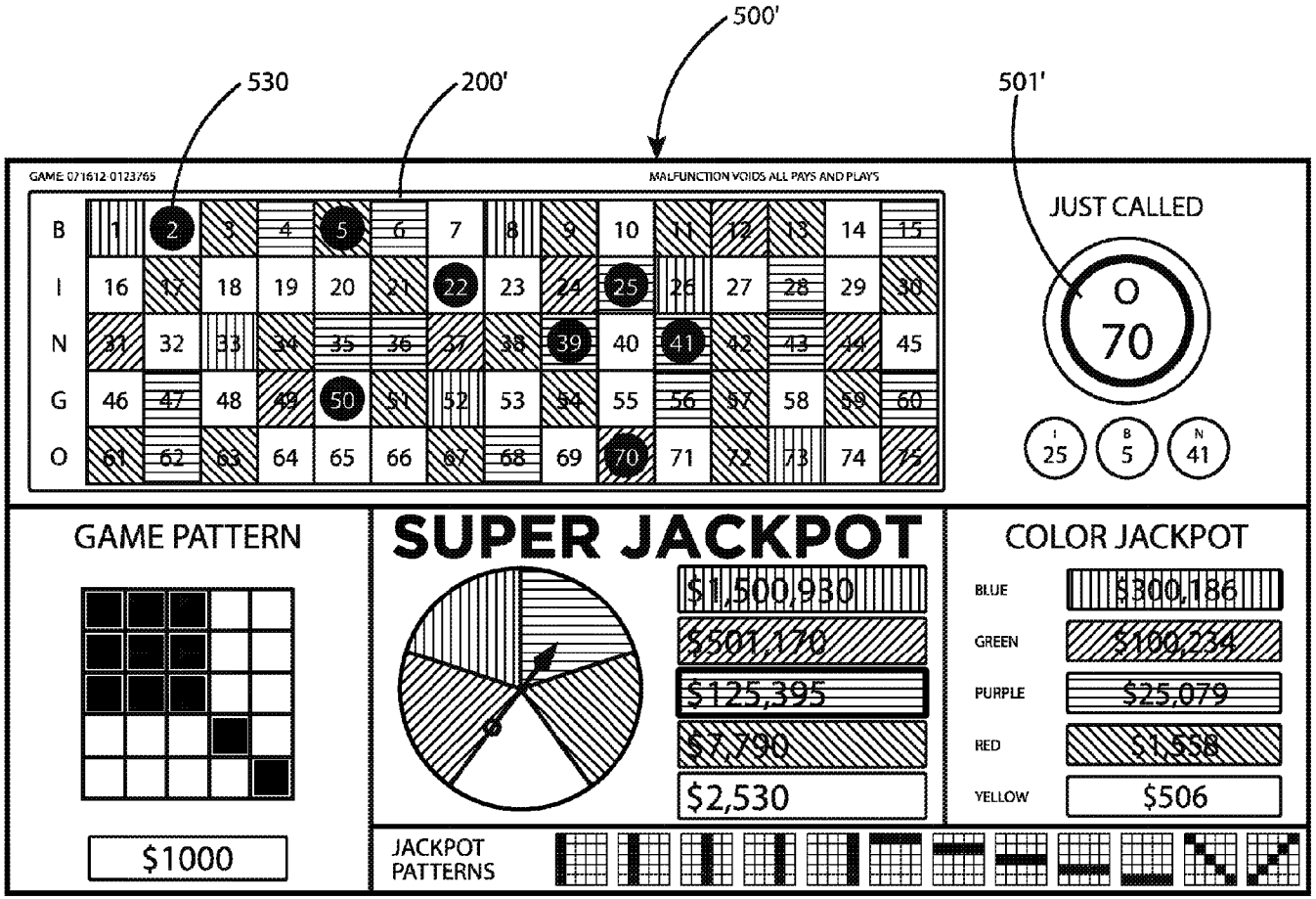
FIG. 11 shows the complete electronic reader board of FIG. 10 in the middle of a game where some balls have been drawn, but no player has achieved the game-ending pattern.
Figure 14:
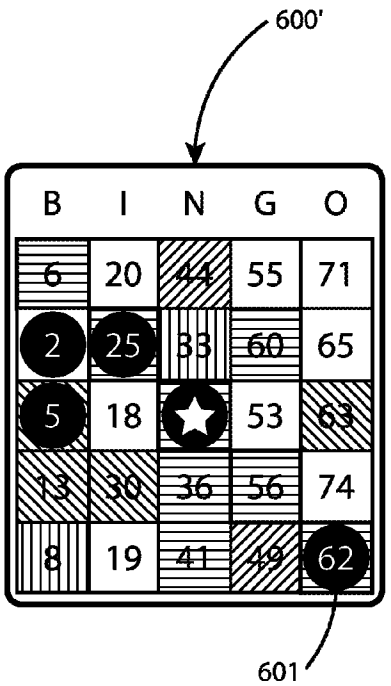
FIG. 14 shows the bingo card of FIG. 13 mid-game with some balls marked.

Balls are drawn and distributed to players sequentially as depicted in FIG. 11 displaying the mid-game state of the electronic reader board display 500' including marked spots for balls called 530 and a populated most recent balls called area 501'. Balls are drawn and distributed sequentially as players compete to be the first to cover the kite-shaped game-ending pattern 514. Although a kite-shaped game-ending pattern is used in this example, it should be clearly understood that a different game-ending pattern may be used. As shown in FIG. 14 the player marks/daubs his bingo card(s) where each space 601 matching a drawn ball 530 appears. The mid-game example card 600' has four marked spaces for (called ball numbers 2, 5, 25, and 62) and one marked free space 208.

Figure 12:
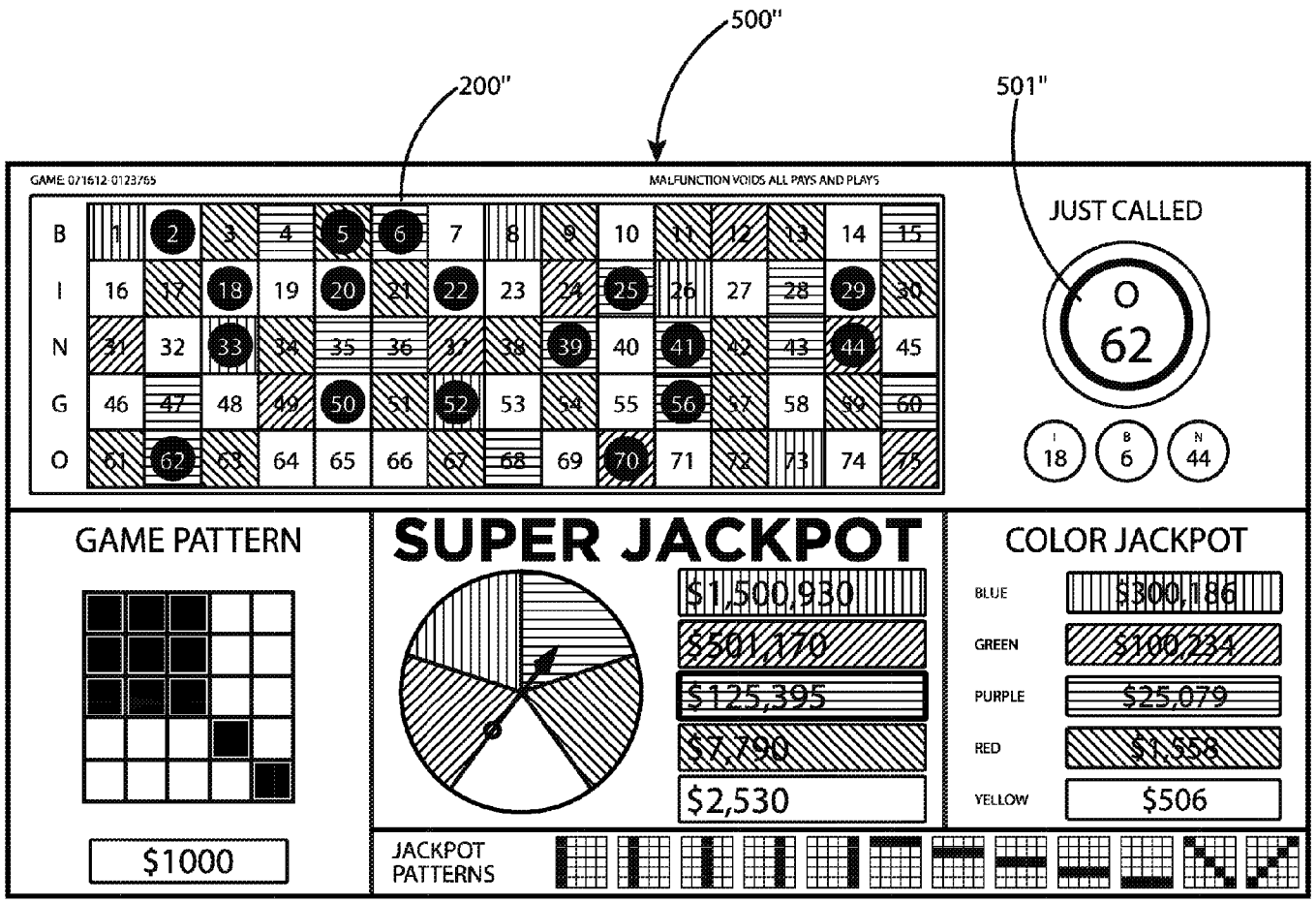
FIG. 12 shows the complete electronic reader board of FIGS. 10 and 11 at the conclusion of the game.
Figure 15:
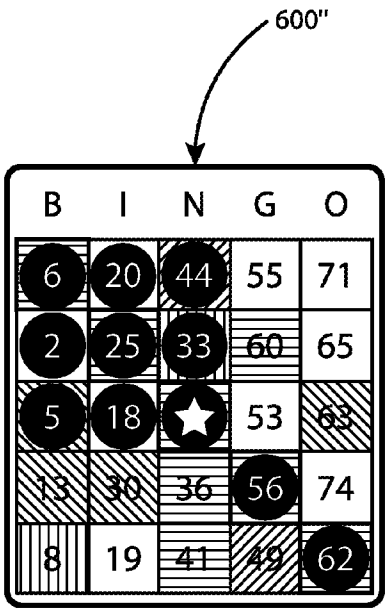
FIG. 15 shows the bingo card of FIGS. 13 and 14 at the conclusion of the game including a marked game-ending pattern and secondary colored progressive pattern match.

FIG. 12 shows the complete electronic reader board display 500" with the fully populated and marked electronic reader board 200" and the final ball called in the populated recent balls called area 501". FIG. 15 shows the player's final card 600" with all spots marked in the kite-shaped game-ending pattern. The card is evaluated and prizes are awarded based on matching the game-ending pattern 514 (in this case, a kite shape), the color bingo pattern 512 (in this case a diagonal line from top left to bottom right), the color of the color jackpot pattern on the player's card 600" (in this case purple 203), and the color pointed to by the spinner pointer 206 (in this case also purple 203). The player is awarded the highest prize achieved, the purple tertiary super jackpot 509. In some implementations, the player will receive one or more of each prize achieved. In this example, this includes the game-ending prize 513 and the purple color jackpot prize 504.

Figure 16:
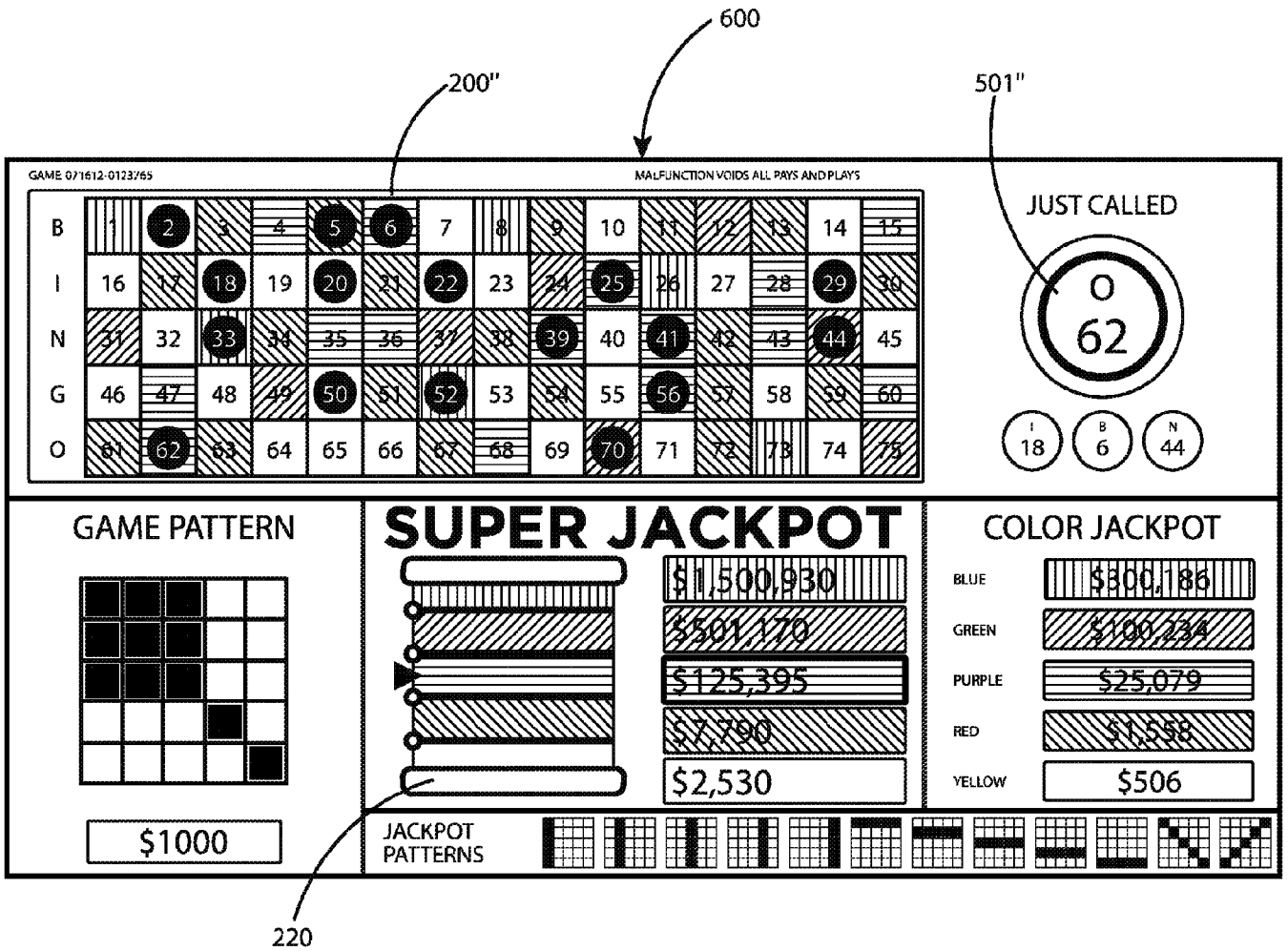
FIG. 16 shows the complete electronic reader board of FIG. 12 with an alternate cylinder style bingo spinner.

Many aspects of the game may be varied to create interesting game play. These variants include the number of colors assigned to the electronic reader board and their associated jackpots, the shape of the game-ending pattern 514, the amount of the game-ending prize 513, the color jackpot patterns 512, the design of the color-selecting spinner device 210, and the amounts of the secondary color-based jackpots 502, 503, 504, 505, 506 and tertiary color based super jackpots 507, 508, 509, 510, 511. For example, FIG. 16 shows an alternative complete electronic reader board 600 in the game completed state of FIG. 12 with a completely populated reader board 200" and a populated recent balls area 501" where a cylinder style spinner 220 substituted for the wheel style spinner 210. As another example, the amount of numbers assigned to each color may be varied in order to increase or decrease the probability of a player's ability to achieve a colored jackpot. In one embodiment that uses five colors (e.g. red, blue, yellow, green, and purple) for the seventy-five ball electronic reader board 200, nineteen numbers may be associated with the color red, seven numbers may be associated with the color blue, twenty-three numbers may be associated with the color yellow, twelve numbers may be associated with the color green, and fourteen numbers may be associated with the color purple. With only seven numbers associated with the color blue and with twenty-three numbers associated with the color yellow, the probability of a player covering five spaces in a straight line pattern with all blue numbers is lower than the player covering five spaces in a straight line pattern with all yellow numbers. Thus, the probability of a blue secondary color jackpot is much lower than the probability of a yellow secondary color jackpot. Therefore, as shown in FIG. 10, the amount of the blue secondary color jackpot prize 502 (e.g. $300,186) is significantly more than the yellow secondary color jackpot prize 506 (e.g. $506). In other embodiments, the amount of numbers assigned to each color may be varied in order to increase or decrease the probability of a player's ability to achieve a colored jackpot on a thirty-ball or ninety-ball electronic number reader board as well. Different secondary color jackpots may also be switched between a local area jackpot or a wide area jackpot; e.g. in the example above, the green secondary color jackpot may be a local area jackpot (comprised of wagers placed by players in a single facility or close geographical location), while the other secondary color jackpots may all be wide area jackpots (comprised of wagers placed by players that are in separate geographical locations).

In another embodiment, it's also possible to designate a specific color, like purple, to have a colored jackpot that is not associated with the GEP, a preliminary "on-the-way" color jackpot. This embodiment makes it possible to have two Progressive jackpots in one game, the secondary color progressive jackpots that are dependent upon the GEP and the on-the-way progressive jackpots which are not dependent upon the GEP. The "on the way" color jackpot is won if the player covers the spaces on his bingo card in a hard-way straight line pattern with numbers that are associated with a single designated color. A hard-way straight line pattern is any five-space straight line pattern on the bingo card that does not use the center free space to form it; e.g. a straight horizontal line on the bottom row of the bingo card. The on-the-way jackpot is won before any player covers the GEP. If a player wins an on-the-way jackpot (e.g. by covering a straight horizontal line on the bottom row of the bingo card with all purple numbers), the game will continue until the same player or another player covers the GEP. The on-the-way player may receive his winnings mid-game or at the end of the game. It is possible for the same person to win the on-the-way jackpot, the GEP prize, the secondary color jackpot, and the spinner super jackpot. It should be clearly understood that the hard-way preliminary progressive jackpot is not meant to be limiting; i.e. other bingo patterns can be used as the preliminary progressive jackpot.

Figure 17:
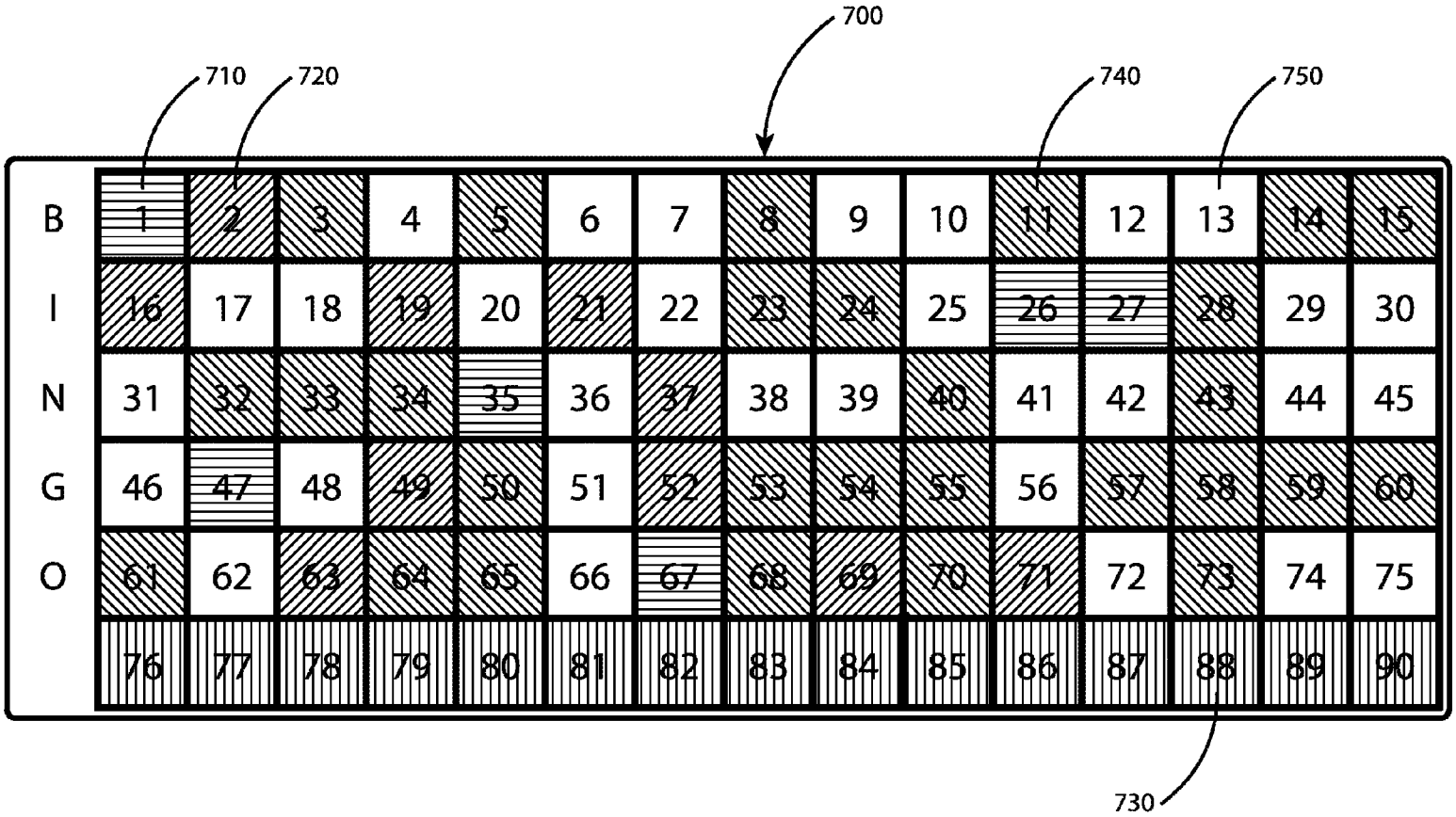
FIG. 17 shows an electronic reader board for a 90-number population typically used in English Bingo with five colors randomly assigned to correspond with five separate color jackpots.
Figure 18A:
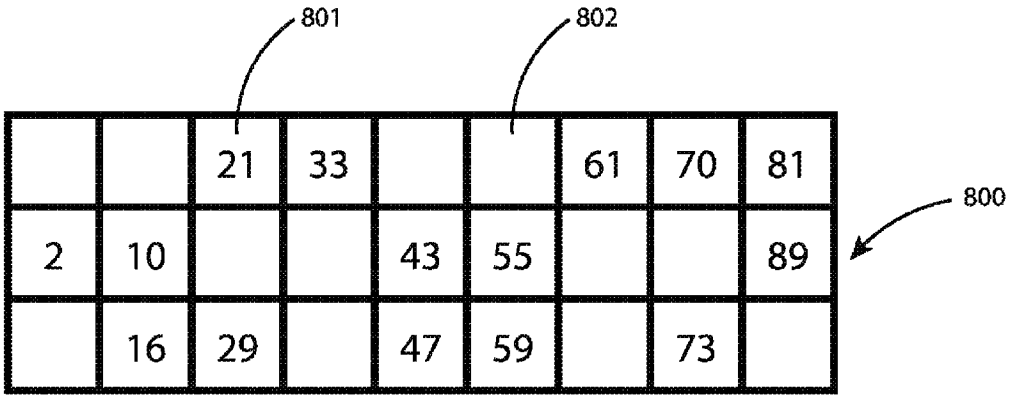
FIG. 18*a* shows a representative bingo card used in English Bingo, wherein the bingo card has one or more horizontal rows, each row having only five numbers and a plurality of blank (free) spaces.
Figure 18B:
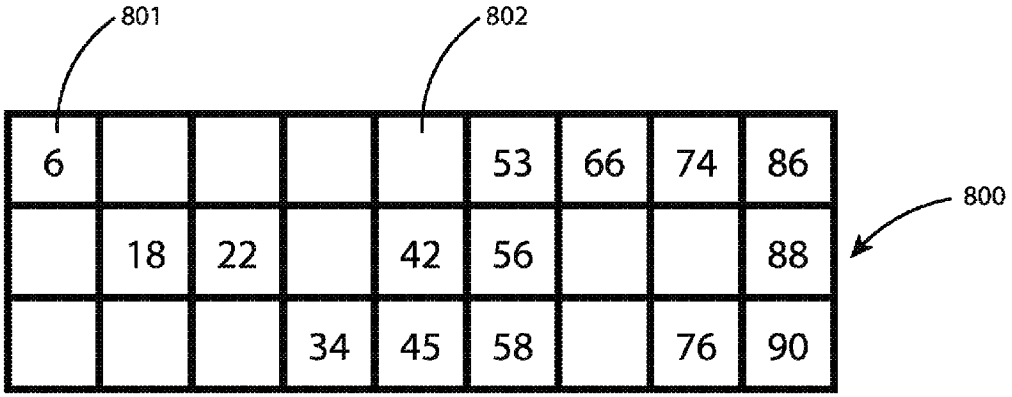
FIG. 18*b* shows another representative bingo card used in English Bingo, wherein the bingo card has one or more horizontal rows, each row having only five numbers and a plurality of blank (free) spaces.

Additional variations include the number of balls on the electronic reader board and the number of spots on a bingo card. FIG. 17 depicts an electronic reader board 700 for a 90-number population referred to as English Bingo with five colors randomly assigned to correspond with a blue jackpot 710, a green jackpot 720, a purple jackpot 730, a red jackpot 740, and a yellow jackpot 750. FIGS. 18*a* and 18*b* each show a representative bingo card 800 used in English Bingo. Each player has a bingo card with one or more horizontal rows, each row having only five numbers 801 and one or more blank (free) spaces 802.

Figure 19A:
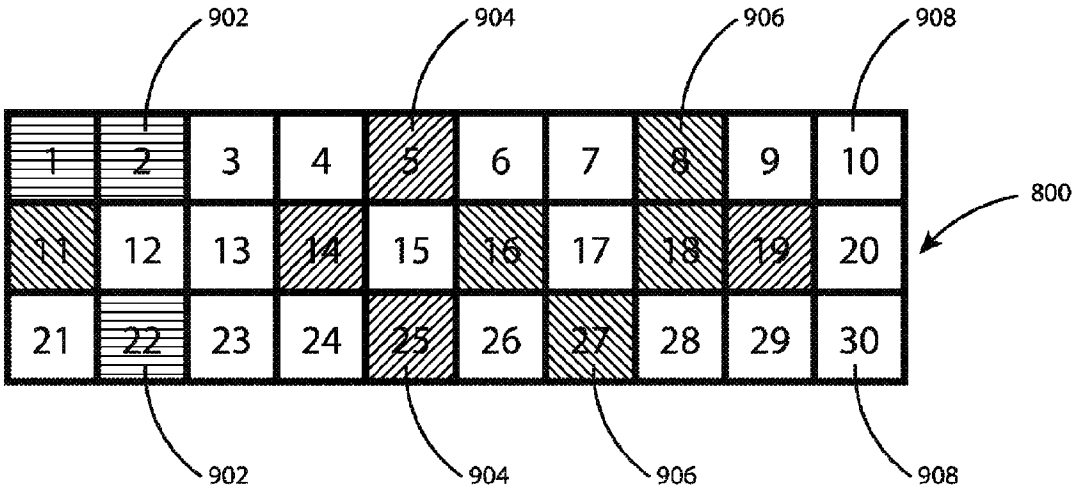
FIG. 19*a* shows an electronic reader board with four colors assigned for four separate color jackpots.
Figure 19B:
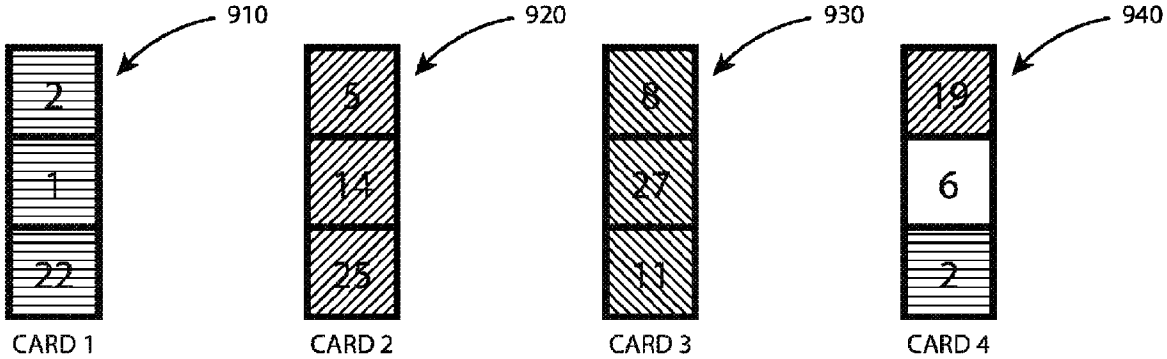
FIG. 19*b* illustrates four representative bingo cards used in Lightening Bingo.

The method of the present invention can also be applied to a variant known as Lightning Bingo or Speed Bingo. In Lightning or Speed Bingo, there is a population of 30 numbers without letter designations. Each player has a bingo card with only three numbers thereon, generally set out in a vertical pattern. FIG. 19*a* illustrates the electronic reader board 800 with four colors assigned for a blue jackpot 902, a green jackpot 904, a purple jackpot 906, and a red jackpot 908. FIG. 19*b* illustrates four representative bingo cards 910, 920, 930, and 940 used in Lightening Bingo.

Figure 20:
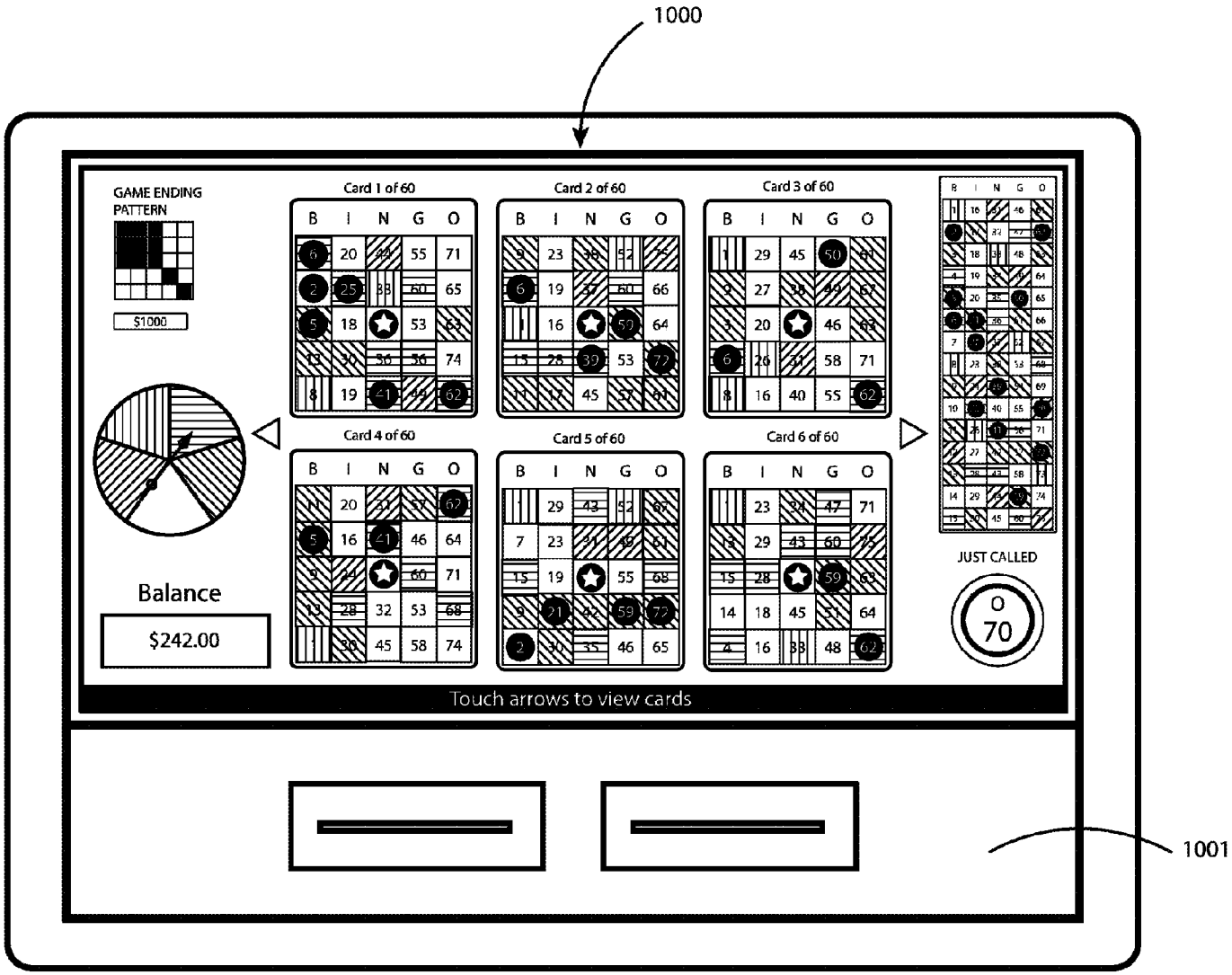
FIG. 20 shows a gaming machine with a screen for displaying an electronic reader board screen of the spinner bingo game of the present invention.

A plurality of gaming machines 1000 may be networked together and connected to a game server. The game server may store and distribute the electronic bingo cards and the electronic bingo balls to the gaming machines 1000. FIG. 20 shows a gaming machine 1000 with a screen for displaying an electronic reader board screen of the spinner bingo game of the present invention. The gaming machine may have a housing and one or more input devices that are supported by the housing. The input device may include acceptors 1001 that are configured to accept wagers from a player or a cashier's station to establish a credit balance. The input devices may also be established via hard wire or wirelessly, to the housing, over the network from a cashier's station. The input device may also receive input instructions from the player (e.g. which numbers to daub on the bingo card) via a touch-screen or keyboard coupled to the housing. Alternatively, the bingo cards may be daubed automatically as the electronic bingo calls are called. The gaming machine will also have an internal electronic processing device to process all of the electronic functions of the gaming machine 1000 required to play the spinner bingo game.

The foregoing description is illustrative of particular embodiments of the application, but is not meant to be limitation upon the practice thereof. While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of adding multi-progressive jackpots to a bingo game comprising the steps of:

providing a game server, the game server configured to store a plurality of electronic bingo cards and a plurality of electronic bingo balls and to distribute the plurality of electronic bingo cards and the plurality of electronic bingo balls to a plurality of bingo gaming machines;

providing the plurality of bingo gaming machines, the bingo gaming machines networked together and connected to the game server, each bingo gaming machine comprising a housing, a screen coupled to the housing, a plurality of input devices coupled to the housing, and an electronic processing device coupled to the housing, the electronic processing device configured to operate the screen and the plurality of input devices;

distributing by the game server to the plurality of bingo gaming machines only seventy-five electronic bingo balls, each electronic bingo ball having a different number;

providing on each bingo gaming machine an electronic number reader board, the electronic number reader board comprising a five-color reader board having a color assigned to each of the seventy-five bingo numbers, a space for recent bingo balls drawn in the bingo game, a predetermined game-ending pattern and an associated payout of the game-ending pattern, and having only seventy-five numbered spaces corresponding to the seventy-five electronic bingo balls used in the bingo game;

distributing by the game server to the plurality of bingo gaming machines the plurality of electronic bingo cards;

providing a plurality of players to operate the plurality of bingo gaming machines, each player having a plurality of electronic bingo cards, the electronic bingo cards having a plurality of numbered spaces, wherein the spaces are arranged in only five columns and only five rows;

randomly assigning seven numbers on the electronic reader board with a blue color, the blue color being associated with a first progressive jackpot amount, wherein the first progressive jackpot amount is established over a wide area network;

randomly assigning twelve numbers on the electronic reader board with a green color, the green color being associated with a second progressive jackpot amount, wherein the second progressive jackpot amount is established over one of the wide area network and a local area network;

randomly assigning fourteen numbers on the electronic reader board with a purple color, the purple color being associated with a third progressive jackpot amount, wherein the third progressive jackpot amount is established over the local area network;

randomly assigning nineteen numbers on the electronic reader board with a red color, the red color being associated with a fourth progressive jackpot amount, wherein the fourth progressive jackpot amount is established over the local area network;

randomly assigning twenty-three numbers on the electronic reader board with a yellow color, the yellow color being associated with a fifth progressive jackpot amount, wherein the fifth progressive jackpot amount is established over the local area network;

providing on the electronic number reader board a spinner display having one blue wedge portion, one green wedge portion, one purple wedge portion, one red wedge portion, and one yellow wedge portion;

providing a spinner device that may select among the blue wedge portion, the green wedge portion, the purple wedge portion, the red wedge portion, and the yellow wedge portion, wherein a size of at least one of the wedge portions is capable of being altered in order to alter a probability that the spinner device will select the wedge portion that has been altered, and wherein additional overlay wedge portions of a predetermined color may be added into portions of each wedge portion of the other colors in order to increase a probability that the spinner device will select the predetermined color;

spinning the spinner device to select one of the wedge portions;

initiating a bingo game;

randomly selecting bingo balls until a player covers the game-ending pattern on the bingo card;

if the player covers the game-ending pattern, awarding the player with a first amount;

if the player also covers a predetermined secondary pattern on the bingo card only with numbers having the same color, awarding the player with a second amount;

if the secondary pattern color on the bingo card matches the color of the wedge portion selected by the spinner device, awarding the player with a third amount; and if a player covers a hard-way straight-line preliminary progressive jackpot pattern on the bingo card prior to any player covering the game-ending pattern and the hard-way straight-line pattern is covered only with numbers having a predetermined color, awarding the player with a fourth amount.

2. The method of claim 1 wherein an amount of numbers assigned with one color may be varied in order to change a probability of covering the predetermined secondary pattern on the bingo card only with numbers assigned with that color.

3. The method of claim 2 further comprising the step of increasing the amount of numbers assigned with the one color and decreasing the second amount that is awarded if the player covers the predetermined secondary pattern on the bingo card only with numbers assigned with that color.

4. The method of claim 2 further comprising the step of decreasing the amount of numbers assigned with the one color and increasing the second amount that is awarded if the player covers the predetermined secondary pattern on the bingo card only with numbers assigned with that color.

5. A method of adding multi-progressive jackpots to a bingo game comprising the steps of:

providing a game server, the game server configured to store a plurality of electronic bingo cards and a plurality of electronic bingo balls and to distribute the plurality of electronic bingo cards and the plurality of electronic bingo balls to a plurality of bingo gaming machines;

providing the plurality of bingo gaming machines, the bingo gaming machines networked together and connected to the game server, each bingo gaming machine comprising a housing, a screen coupled to the housing, a plurality of input devices coupled to the housing, and an electronic processing device coupled to the housing, the electronic processing device configured to operate the screen and the plurality of input devices;

distributing by the game server to the plurality of bingo gaming machines only seventy-five electronic bingo balls, each electronic bingo ball having a different number;

providing on each bingo gaming machine an electronic number reader board, the electronic number reader board comprising a five-color reader board having a color assigned to each of the seventy-five bingo numbers, a space for recent bingo balls drawn in the bingo game, a predetermined game-ending pattern and an associated payout of the game-ending pattern, and having only seventy-five numbered spaces corresponding to the seventy-five electronic bingo balls used in the bingo game;

distributing by the game server to the plurality of bingo gaming machines the plurality of electronic bingo cards;

providing a plurality players to operate the plurality of bingo gaming machines, each player having a plurality of electronic bingo cards, the electronic bingo cards having a plurality of numbered spaces, wherein the spaces are arranged in only five columns and only five rows;

randomly assigning seven numbers on the electronic reader board with blue, blue being associated with a first progressive jackpot amount, wherein the first progressive jackpot amount is established over a wide area network;

randomly assigning twelve numbers on the electronic reader board with green, green being associated with a second progressive jackpot amount, wherein the second progressive jackpot amount is established over one of the wide area network and a local area network;

randomly assigning fourteen numbers on the electronic reader board with purple, purple being associated with a third progressive jackpot amount, wherein the third progressive jackpot amount is established over the local area network;

randomly assigning nineteen numbers on the electronic reader board with red, red being associated with a fourth progressive jackpot amount, wherein the fourth progressive jackpot amount is established over the local area network;

randomly assigning twenty-three numbers on the electronic reader board with yellow, yellow being associated with a fifth progressive jackpot amount, wherein the fifth progressive jackpot amount is established over the local area network;

providing on the electronic number reader board a spinner display having one blue wedge portion, one green wedge portion, one purple wedge portion, one red wedge portion, and one yellow wedge portion;

providing a spinner device that may select among the blue wedge portion, the green wedge portion, the purple wedge portion, the red wedge portion, and the yellow wedge portion, wherein a size of at least one of the wedge portions is capable of being altered in order to alter a probability that the spinner device will select the wedge portion that has been altered, and wherein additional overlay wedge portions of a predetermined color may be added into portions of each wedge portion of the other colors in order to increase a probability that the spinner device will select the predetermined color;

spinning the spinner device to select one of the wedge portions;

initiating a bingo game;

randomly selecting bingo balls until a player covers the game-ending pattern on the bingo card;

if the player covers the game-ending pattern, awarding the player with a first amount;

if the player also covers a predetermined secondary pattern on the bingo card only with numbers having the same color, awarding the player with a second amount; and if the secondary pattern color on the bingo card matches the color of the wedge portion selected by the spinner device, awarding the player with a third amount.

6. The method of claim 5 further comprising if a player covers a hard-way straight-line pattern on the bingo card prior to any player covering the game-ending pattern and the hard-way straight-line pattern is covered only with numbers having a predetermined color, awarding the player with a fourth amount.

7. The method of claim 5 wherein an amount of numbers assigned with one color may be varied in order to change a probability of covering the predetermined secondary pattern on the bingo card only with numbers assigned with that color.

8. The method of claim 7 further comprising the step of increasing the amount of numbers assigned with the one color and decreasing the second amount that is awarded if the player covers the predetermined secondary pattern on the bingo card only with numbers assigned with that color.

9. The method of claim 7 further comprising the step of decreasing the amount of numbers assigned with the one color and increasing the second amount that is awarded if the player covers the predetermined secondary pattern on the bingo card only with numbers assigned with that color.

10. A method of adding multi-progressive jackpots to a bingo game comprising the steps of:

providing a game server, the game server configured to store a plurality of electronic bingo cards and a plurality of electronic bingo balls and to distribute the plurality of electronic bingo cards and the plurality of electronic bingo balls to a plurality of bingo gaming machines;

providing the plurality of bingo gaming machines, the bingo gaming machines networked together and connected to the game server, each bingo gaming machine comprising a housing, a screen coupled to the housing, a plurality of input devices coupled to the housing, and an electronic processing device coupled to the housing, the electronic processing device configured to operate the screen and the plurality of input devices;

distributing by the game server to the plurality of bingo gaming machines only seventy-five electronic bingo balls, each bingo ball having a different number;

providing on each bingo gaming machine an electronic number reader board, the electronic number reader board comprising a five-color reader board having a color assigned to each of the seventy-five bingo numbers, a space for recent bingo balls drawn in the bingo game, a predetermined game-ending pattern and an associated payout of the game-ending pattern, and having only seventy-five numbered spaces corresponding to the seventy-five electronic bingo balls used in the bingo game;

distributing by the game server to the plurality of bingo gaming machines the plurality of electronic bingo cards;

providing a plurality of players to operate the plurality of bingo gaming machines, each player having a plurality of electronic bingo cards, the electronic bingo cards having a plurality of numbered spaces, wherein the spaces are arranged in only five columns and only five rows;

randomly assigning a predetermined amount of numbers on the electronic reader board with a first color, the first color being associated with a first progressive jackpot amount, wherein the first progressive jackpot amount is established over a wide area network;

randomly assigning a predetermined amount of numbers on the electronic reader board with a second color, the second color being associated with a second progressive jackpot amount, wherein the second progressive jackpot amount is established over one of the wide area network and a local area network;

randomly assigning a predetermined amount of numbers on the electronic reader board with a third color, the third color being associated with a third progressive jackpot amount, wherein the third progressive jackpot amount is established over the local area network;

randomly assigning a predetermined amount of numbers on the electronic reader board with a fourth color, the fourth color being associated with a fourth progressive jackpot amount, wherein the fourth progressive jackpot amount is established over the local area network;

randomly assigning a predetermined amount of numbers on the electronic reader board with a fifth color, the fifth color being associated with a fifth progressive jackpot amount, wherein the fifth progressive jackpot amount is established over the local area network;

providing on the electronic number reader board a spinner display wherein at least one wedge portion of the spinner display matches each of the first color, the second color, the third color, the fourth color, and the fifth color;

providing a spinner device that may select among each of the wedge portions of the spinner display that match the first color, the second color, the third color, the fourth color, and the fifth color, wherein a size of at least one of the wedge portions is capable of being altered in order to alter a probability that the spinner device will select the wedge portion that has been altered, and wherein additional overlay wedge portions of a predetermined color may be added into portions of each wedge portion of the other colors in order to increase a probability that the spinner device will select the predetermined color;

spinning the spinner device to select one of the wedge portions;

initiating a bingo game;

randomly selecting bingo balls until a player covers the game-ending pattern on the bingo card;

if the player covers the game-ending pattern, awarding the player with a first amount;

if the player also covers a predetermined secondary pattern on the bingo card only with numbers having the same color, awarding the player with a second amount; and if the secondary pattern color on the bingo card matches the color of the wedge portion selected by the spinner device, awarding the player with a third amount.

11. The method of claim 10 further comprising if a predetermined preliminary progressive jackpot pattern on the bingo card is covered prior to any player covering the game-ending pattern and the preliminary pattern of spaces is covered only with numbers having a predetermined color, awarding the player with a fourth amount.

12. The method of claim 11 wherein the preliminary progressive jackpot pattern on the bingo card is a bingo pattern other than the game ending pattern.

13. The method of claim 10 wherein an amount of numbers assigned with one color may be varied in order to change a probability of covering the predetermined secondary pattern on the bingo card only with numbers assigned with that color.

14. A method of adding multi-progressive jackpots to a bingo game comprising the steps of:

providing a game server, the game server configured to store a plurality of electronic bingo cards and a plurality of electronic bingo balls and to distribute the plurality of electronic bingo cards and the plurality of electronic bingo balls to a plurality of bingo gaming machines;

providing the plurality of bingo gaming machines, the bingo gaming machines networked together and connected to the game server, each bingo gaming machine comprising a housing, a screen coupled to the housing, a plurality of input devices coupled to the housing, and an electronic processing device coupled to the housing, the electronic processing device configured to operate the screen and the plurality of input devices;

distributing by the game server to the plurality of bingo gaming machines only seventy-five electronic bingo balls, each electronic bingo ball having a different number;

providing on each bingo gaming machine an electronic number reader board, the electronic number reader board comprising a five-color reader board having a color assigned to each of the seventy-five bingo numbers, a space for recent bingo balls drawn in the bingo game, a predetermined game-ending pattern and an associated payout of the game-ending pattern, and having only seventy-five numbered spaces corresponding to the seventy-five electronic bingo balls used in the bingo game;

distributing by the game server to the plurality of bingo gaming machines the plurality of electronic bingo cards;

providing a plurality of players to operate the plurality of bingo gaming machines, each player having a plurality of electronic bingo cards, the electronic bingo cards having a plurality of numbered spaces, wherein the spaces are arranged in only five columns and only five rows;

randomly assigning a predetermined amount of numbers on the electronic reader board with a first designated marking, the first designated marking being associated with a first progressive jackpot amount, wherein the first progressive jackpot amount is established over a wide area network;

randomly assigning a predetermined amount of numbers on the electronic reader board with a second designated marking, the second designated marking being associated with a second progressive jackpot amount, wherein the second progressive jackpot amount is established over one of the wide area network and a local area network;

randomly assigning a predetermined amount of numbers on the electronic reader board with a third designated marking, the third designated marking being associated with a third progressive jackpot amount, wherein the third progressive jackpot amount is established over the local area network;

randomly assigning a predetermined amount of numbers on the electronic reader board with a fourth designated marking, the fourth designated marking being associated with a fourth progressive jackpot amount, wherein the fourth progressive jackpot amount is established over the local area network;

randomly assigning a predetermined amount of numbers on the electronic reader board with a fifth designated marking, the fifth designated marking being associated with a fifth progressive jackpot amount, wherein the fifth progressive jackpot amount is established over the local area network;

providing on the electronic number reader board a spinner display wherein at least one wedge portion of the spinner display matches each of the first designated marking, the second designated marking, the third designated marking, the fourth designated marking, and the fifth designated marking;

providing a spinner device that may select among each of the wedge portions of the spinner display that match the first designated marking, the second designated marking, the third designated marking, the fourth designated marking, and the fifth designated marking, wherein a size of at least one of the wedge portions is capable of being altered in order to alter a probability that the spinner device will select the wedge portion that has been altered, and wherein additional overlay wedge portions of a predetermined designated marking may be added into portions of each wedge portion of the other designated markings in order to increase a probability that the spinner device will select the predetermined designated marking;

spinning the spinner device to select one of the wedge portions;

initiating a bingo game;

randomly selecting bingo balls until a player covers the game-ending pattern on the bingo card;

if the player covers the game-ending pattern, awarding the player with a first amount;

if the player also covers a predetermined secondary pattern on the bingo card only with numbers having the same designated marking, awarding the player with a second amount; and if the designated marking of the secondary pattern on the bingo card matches the designated marking of the wedge portion selected by the spinner device, awarding the player with a third amount.

15. The method of claim 14 wherein each of the first designated marking, the second designated marking, the third designated marking, the fourth designated marking, and the fifth designated marking comprise a different color.

16. The method of claim 14 further comprising randomly assigning a predetermined amount of numbers on the electronic reader board with a sixth designated marking.

17. The method of claim 14 further comprising if a predetermined preliminary progressive jackpot pattern on the bingo card is covered prior to any player covering the game-ending pattern and the preliminary pattern of spaces is covered only with numbers having a predetermined color, awarding the player with a fourth amount.

18. The method of claim 14 wherein an amount of numbers assigned with one designated marking may be varied in order to change a probability of covering the predetermined secondary pattern on the bingo card only with numbers assigned with that designated marking.

19. The method of claim 18 further comprising the step of increasing the amount of numbers assigned with the one designated marking and decreasing the second amount that is awarded if the player covers the predetermined secondary pattern on the bingo card only with numbers assigned with that designated marking.

20. The method of claim 18 further comprising the step of decreasing the amount of numbers assigned with the one designated marking and increasing the second amount that is awarded if the player covers the predetermined secondary pattern on the bingo card only with numbers assigned with that designated marking.

21. A method of adding multi-progressive jackpots to a bingo game comprising the steps of:

providing a game server, the game server configured to store a plurality of electronic bingo cards and a plurality of electronic bingo balls and to distribute the plurality of electronic bingo cards and the plurality of electronic bingo balls to a plurality of bingo gaming machines;

providing the plurality of bingo gaming machines, the bingo gaming machines networked together and connected to the game server, each bingo gaming machine comprising a housing, a screen coupled the housing, a plurality of input devices coupled to the housing, and an electronic processing device coupled to the housing, the electronic processing device configured to operate the screen and the plurality of input devices;

distributing by the game server to the plurality of bingo gaming machines a plurality of electronic bingo balls, each electronic bingo ball having a different number;

providing on each bingo gaming machine an electronic number reader board, the electronic number reader board comprising a five-color reader board having a color assigned to each of the seventy-five bingo numbers, a space for recent bingo balls drawn in the bingo game, a predetermined game-ending pattern and an associated payout of the game-ending pattern, and having only seventy-five numbered spaces corresponding to the seventy-five electronic bingo balls used in the bingo game;

distributing by the game server to the plurality of bingo gaming machines the plurality of electronic bingo cards;

providing a plurality of players to operate the plurality of bingo gaming machines, each having an electronic bingo card, the electronic bingo card having a plurality of numbered spaces;

randomly assigning a predetermined amount of numbers on the electronic reader board with at least one designated marking, the at least one designated marking being associated with at least one progressive jackpot amount, wherein the at least one progressive jackpot amount is established over one of a wide area network and a local area network;

providing on the electronic number reader board a spinner display wherein at least one wedge portion of the spinner display matches the at least one designated marking assigned to the predetermined amount of numbers on the electronic reader board;

providing a spinner device that may select the at least one wedge portion of the spinner display that matches the at least one designated marking assigned to the predetermined amount of numbers on the electronic reader board, wherein a size of the at least one of the wedge portions is capable of being altered in order to alter a probability that the spinner device will select the at least one wedge portion that has been altered, and wherein additional overlay wedge portions of one predetermined designated marking may be added into portions of any other wedge portion of any other designated marking in order to increase a probability that the spinner device will select the predetermined designated marking;

spinning the spinner device to select one of the wedge portions;

initiating a bingo game;

randomly selecting bingo balls until a player covers the game-ending pattern on the bingo card;

if the player covers the game-ending pattern, awarding the player with a first amount;

if the player also covers a predetermined secondary pattern on the bingo card only with numbers having the same at least one designated marking, awarding the player with a second amount; and if the at least one designated marking of the secondary pattern on the bingo card matches the at least one designated marking of the wedge portion selected by the spinner device, awarding the player with a third amount.

22. The method of claim 21 wherein the at least one designated marking is a color.

23. The method of claim 22 wherein the at least one designated marking comprises four different colors.

24. The method of claim 22 wherein the at least one designated marking comprises five different colors.

25. The method of claim 22 wherein the at least one designated marking comprises six different colors.

26. The method of claim 21 further comprising if a predetermined preliminary progressive jackpot pattern on the bingo card is covered prior to any player covering the game-ending pattern and the preliminary pattern of spaces is covered only with numbers having a predetermined designated marking, awarding the player with a fourth amount.

27. The method of claim 21 wherein an amount of numbers assigned with the at least one designated marking may be varied in order to change a probability of covering the predetermined secondary pattern on the bingo card only with numbers assigned with the at least one designated marking.

28. The method of claim 27 further comprising the step of increasing the amount of numbers assigned with the at least one designated marking and decreasing the second amount that is awarded if the player covers the predetermined secondary pattern on the bingo card only with numbers assigned with the at least one designated marking.

29. The method of claim 27 further comprising the step of decreasing the amount of numbers assigned with the at least one designated marking and increasing the second amount that is awarded if the player covers the predetermined secondary pattern on the bingo card only with numbers assigned with the at least one designated marking.

* * * * *